United States Patent [19]

Nishi et al.

[11] Patent Number: 4,864,289

[45] Date of Patent: Sep. 5, 1989

[54] VIDEO DISPLAY CONTROL SYSTEM FOR ANIMATION PATTERN IMAGE

[75] Inventors: Kazuhiko Nishi; Takatoshi Ishii; Ryozo Yamashita, all of Tokyo; Shigemitsu Yamaoka; Takatoshi Okumura, both of Hamamatsu, all of Japan

[73] Assignees: ASCII Corporation, Tokyo; Nippon Gakki Seizo Kabushiki Kaisha, Hamamatsu, both of Japan

[21] Appl. No.: 9,095

[22] Filed: Jan. 23, 1987

Related U.S. Application Data

[63] Continuation of Ser. No. 722,074, Apr. 11, 1985.

[30] Foreign Application Priority Data

| | | | |
|---|---|---|---|
| Apr. 13, 1984 | [JP] | Japan | 59-074431 |
| Apr. 14, 1984 | [JP] | Japan | 59-075620 |
| Apr. 14, 1984 | [JP] | Japan | 59-075621 |
| Apr. 24, 1984 | [JP] | Japan | 59-082736 |

[51] Int. Cl.[4] ..... G09G 1/00

[52] U.S. Cl. ..... 340/725; 340/723; 340/724

[58] Field of Search ..... 340/701, 703, 723, 724, 340/725, 726, 721, 744, 792, 800; 273/1 E, 85 G, DIG. 28

[56] References Cited

U.S. PATENT DOCUMENTS

| | | | |
|---|---|---|---|
| 4,101,879 | 7/1978 | Kawaji et al. | 340/703 X |
| 4,129,859 | 12/1978 | Iwamura et al. . | |
| 4,180,805 | 12/1979 | Burson | 340/724 |
| 4,232,374 | 11/1980 | Chung et al. . | |
| 4,243,984 | 1/1981 | Ackley et al. . | |
| 4,310,840 | 1/1982 | Willams et al. | 340/724 |
| 4,367,466 | 1/1983 | Takeda et al. | 340/725 |
| 4,437,093 | 3/1984 | Bradley | 340/724 X |
| 4,439,759 | 3/1984 | Fleming et al. | 340/703 |
| 4,445,114 | 4/1984 | Stubben | 340/726 |
| 4,454,593 | 6/1984 | Fleming et al. | 340/703 |
| 4,471,464 | 9/1984 | Mayer et al. | 340/725 |
| 4,484,187 | 11/1984 | Brown et al. | 340/703 |
| 4,536,848 | 8/1985 | d'Entremont et al. | 340/703 |
| 4,559,533 | 12/1985 | Bass et al. | 340/724 |
| 4,580,134 | 4/1986 | Campbell et al. | 340/725 X |
| 4,580,135 | 4/1986 | Kummi et al. | 340/703 X |
| 4,584,572 | 4/1986 | Lambert, III | 340/703 |
| 4,675,666 | 6/1987 | Peterson | 340/703 |

FOREIGN PATENT DOCUMENTS

| | | | |
|---|---|---|---|
| 0099188 | 5/1985 | European Pat. Off. . | |
| 0085480 | 9/1985 | European Pat. Off. . | |
| 2732438 | 1/1978 | Fed. Rep. of Germany . | |
| 2477745 | 9/1981 | France . | |
| 0020517 | 2/1980 | Japan | 340/703 |

*Primary Examiner*—David K. Moore
*Assistant Examiner*—Jeffery A. Brier
*Attorney, Agent, or Firm*—Cushman, Darby & Cushman

[57] ABSTRACT

A video display control system displays a multicolor animation pattern on a screen of a video display unit. The video display control system is mainly constructed by a video RAM (VRAM) and a video display processor (VDP). The VRAM stores animation pattern data, display position data and at least two color data. The VDP reads these data and makes an animation pattern image displayed in at least two colors at a display position on the screen. The animation pattern image, two colors and display position are determined by the animation pattern data, two color data and display position data. In another video display control system, the VRAM stores at least two sets of animation pattern data, display position data and color data. When displaying two animation patterns, the VDP effects a logical operation on the two color data with respect to the overlapping portion of the two patterns and makes the overlapping portion displayed in a new color corresponding to the operation result. When the animation patterns overlaps, the VDP can also deliver a collision signal in place of the logical operation, thereby enabling a CPU to recognize the position of the overlapping portion.

5 Claims, 19 Drawing Sheets

(a)

(b)

(a)

(b)

| color code | color data | | | color |
|---|---|---|---|---|
| | GD | RD | BD | |
| 0 0 0 0 | 0 0 0 | 0 0 0 | 0 0 0 | black (transparent) |
| 0 0 0 1 | 0 0 0 | 0 0 0 | 0 1 0 | dark blue |
| 0 0 1 0 | 0 0 0 | 0 1 0 | 0 0 0 | dark red |
| 0 0 1 1 | 0 0 0 | 0 1 0 | 0 1 0 | dark mazenta |
| 0 1 0 0 | 0 1 0 | 0 0 0 | 0 0 0 | dark green |
| 0 1 0 1 | 0 1 0 | 0 0 0 | 0 1 0 | dark yellow |
| 0 1 1 0 | 0 1 0 | 0 1 0 | 0 0 0 | dark cyan |
| 0 1 1 1 | 0 1 0 | 0 1 0 | 0 1 0 | gray |
| 1 0 0 0 | 1 0 0 | 1 1 1 | 0 1 0 | beige |
| 1 0 0 1 | 0 0 0 | 0 0 0 | 1 0 0 | blue |
| 1 0 1 0 | 0 0 0 | 1 0 0 | 0 0 0 | red |
| 1 0 1 1 | 0 0 0 | 1 0 0 | 1 0 0 | mazenta |
| 1 1 0 0 | 1 0 0 | 0 0 0 | 0 0 0 | green |
| 1 1 0 1 | 1 0 0 | 0 0 0 | 1 0 0 | yellow |
| 1 1 1 0 | 1 0 0 | 1 0 0 | 0 0 0 | cyan |
| 1 1 1 1 | 1 0 0 | 1 0 0 | 1 0 0 | white |

FIG. 18 shift controller
decoder
SPPT
LOAD
SIZE
MAG
DCP
CS
XL
HO
CL
CIr
EC
IC
CC
C0
C1
C2
C3
VRL 0
VRL 1
VRL 2
VRL 3
VRL 4
VRL 5
VRL 6
VRL 7
INV

VIDEO DISPLAY CONTROL SYSTEM FOR ANIMATION PATTERN IMAGE

BACKGROUND OF THE INVENTION

This is a continuation of application Ser. No. 722,074, filed Apr. 11, 1985.

1. Field of the Invention

This invention relates to a display controller for use in terminal equipment for a computer or video machines and particularly to such a display controller of the type in which animation pattern images can be displayed on a display screen.

2. Prior Art

There have recently been proposed a video display controller for a video game machine or the like by which a combination of an animation pattern image and a still pattern image can be displayed on a display screen. For displaying an animation pattern formed by, for example, 8×8 dots or display elements on the screen, data representative of the animation pattern image and composed of a bit pattern of 8×8 bits is read from a video RAM and fed to a CRT display unit. The display position of this animation pattern on the display screen is sequentially shifted to achieve a mobile image. At this time, a still pattern image is also displayed on the display screen as the background of the displayed image.

U.S. Pat. No. 4,243,984 discloses a video display controller of the kind described above. With the conventional display controller, however, each animation pattern can be displayed only in one selected color Thus, it has not been possible to display a multi-color animation patterns on the display screen. Also, with the conventional controller, when two animation patterns overlap, the overlapping portion is displayed in whichever color of the animation pattern has a higher priority. Thus, the overlapping condition has not been properly expressed on the screen.

The conventional video display controller is so designed as to detect a collision of one animation pattern with another on the screen. This function is very useful for a game machine in which a collision of an animation pattern, such as a cannonball, with another animation pattern such as an airplane, has to be detected to play the game. The conventional video display controller, however, does not detect the position on the screen at which the collision occurs, and therefore a central processing unit controlling the video display controller has to obtain the collision position by executing a program for the detection of the collision position. Furthermore, with this conventional video display controller, any collisions which occur on the screen have detected, so that an additional program must be provided for detecting only the required collisions.

There has also been proposed another video display control system of which block diagram is shown in FIG. 1. However, this conventional video display controller is disadvantageous in that the number of animation pattern images or sprites which can be displayed on one horizontal scanning line is relatively small (for example, four). This has much limited a pattern arrangement on the display screen. The reason for this will now be described with reference to the drawings.

A central processing unit (CPU) 1 shown in FIG. 1 controls this conventional video display controller 2 to cause selected pattern images to be displayed on a screen of a CRT display unit 3. A memory 4 stores programs which control the CPU 1 and provides for work areas for storing data to be processed by the CPU 1. As shown in FIG. 2, a video RAM (VRAM) 5 comprises a still pattern table area 5*a* for storing data representative of dot patterns of still patterns, a still pattern control table area 5*b* for storing data representative of the display position of each still pattern, a still pattern color table area 5*c* for storing a color code (4 bits) of each still pattern, an animation pattern table area 5*d* for storing data representative of a plurality of animation patterns, and an animation pattern control table area 5*e* for storing data representative of the display position of each animation pattern. The animation pattern table area 5*d* stores 256 animation pattern data P0, P1, P2 . . . P255 each composed of 8 bytes (FIG. 3-(*a*)). Thus, each of the animation pattern data P0 to P255 represents an animation pattern which is composed of 8×8 bits (one example is shown in FIG. 3-(*b*)). In this case, bits "1" of each pattern data represent the foreground of the corresponding animation pattern, while bits "0" thereof represent the background of the animation pattern. As shown in FIG. 4-(*a*), the animation pattern control table area 5*e* stores 32 tables C0, C1, C3 . . . C31 each composed of 4 bytes (FIG. 4-(*b*)). A name of a selected animation pattern Pi (i=0, 1, 2 . . . 255) is stored in the third byte of each animation pattern control table Ck (k=0, 1 . . . 31), and the column position (X coordinate) and row position (Y coordinate) of the display position of the animation pattern Pi are stored in the second byte and first byte of the table Ck, respectively. A color code of the animation pattern Pi and EC bit are stored in the fourth byte of the table Ck. As shown in FIG. 5, the display position (X, Y) means that the number of display elements counting right horizontally from the upper left end of the display screen representing the origin (0, 0) is X while the number of display elements counting vertically downwardly from the upper left end of the screen is Y. This display position (X, Y) represents the upper left end of the animation pattern Pi displayed on the screen.

The display controller 2 will now be described.

A timing signal generator 6 produces master clock pulses in accordance with an output of a crystal oscillator provided therein, and based on these clock pules, horizontal and vertical synchronization signals SYNC are produced and fed to the CRT display unit 3. Also, the timing signal generator 6 feeds dot clock pulses DCP to a clock input terminal of a horizontal counter 7. The horizontal counter 7 serves to determine the display position of each display element on the screen in the horizontal direction, and the display position is shifted by one dot in the right-hand direction each time the contents NH of the horizontal counter 7 are incremented by one. When the count NH is 0, the display element at the left end of each scanning line on the screen is displayed, and when the count NH is 255, the display element at the right end of each scanning line on the screen is displayed. A horizontal non-display period is established when the count NH is in the range of between 256 and 340. Each time the count NH reaches 340, the horizontal counter 7 feeds a pulse signal HP to a clock input terminal of a vertical counter 8. The vertical counter 8 serves to determine the display position of each display element on the screen in the vertical direction, that is to say, to determine the number of the horizontal scanning line. The horizontal scanning line is shifted downwardly by one each time the count NV of the vertical counter 8 is incremented by one. When the count NV is 0, the display elements on the uppermost horizontal scanning line are displayed. When the count NV is 191, the display elements on the lowermost horizontal scanning line are displayed. A vertical non-display period is established when the count NV is in the range of between 192 and 261.

An image data processing circuit 9 is connected to the CPU 1 via an interface circuit 10 and also to the VRAM 5. The image data processing circuit 9 serves to write data, fed from the CPU 1, into the respective table areas of the VRAM 5 and also to read the data written into the VRAM 5 therefrom under the control of the CPU 1 to effect various display controls. More specifically, in the case of the still pattern display, the image data processing circuit 9 reads from the still pattern control table area **5*b* each of the data representative of the names and display positions of the still patterns and color codes thereof, which are written thereto during the above-mentioned vertical non-display period, immediately before the display of the corresponding still pattern on the display screen, that is to say, that time period corresponding to 8 display elements before the display of this still pattern, and in accordance with the read data, the image data processing circuit 9 reads from the still pattern table area 5*a* the dot data representative of the still pattern to be displayed at this time and loads the corresponding dot data and color code into a shift register and a color information register, respectively. And, during the display period, the bits contained in the shift register are shifted out one by one, and the color code in the color information register, which represents a color of the foreground of the still pattern, is fed to a color palette circuit 11 in accordance with the output of the shift register. The color palette circuit 11 converts each of the color codes into color data RD, GD and BD representing red, green and blue, respectively, and a digital-analog converter 12 converts the color data RD, GD and BD into analog color signals R, G and B, respectively, and feeds them to the CRT display unit 3** to thereby display the display elements of the still pattern on the screen in the selected color.

The display of each animation pattern is effected by the image data processing circuit 9 and four animation pattern processing circuits 13. More specifically, under the control of the CPU 1, during the vertical non-display period, the image data processing circuit 9 sequentially writes into the animation pattern control table Ck the name data, display position data, color code and EC bit data of each animation pattern Pi to be displayed in the next frame. The image data processing circuit 9 sequentially reads and checks the Y coordinates of the animation patterns in the control tables C0 to C31 during each horizontal scanning period to determine whether any animation patterns should be displayed during the next horizontal scanning period, and loads into a register address data representative of those addresses of the animation pattern control tables Ck containing data representative of animation patterns Pi to be displayed next. During each horizontal non-display period, the data representative of the X coordinates in those animation pattern control tables Ck designated by the above address data are loaded respectively to X counters of animation pattern processing circuits 13. Also, the dot data each representative of a row of display elements of a respective one of the animation patterns to be displayed on the next horizontal scanning line are read from the corresponding addresses of the animation pattern table area **5*d*, which are determined by the count NV of the vertical counter 8 and the Y coordinates in the animation control tables Ck, and are loaded into corresponding pattern shift registers of the animation pattern processing circuits 13. Thus, the dot data representative of the display elements of the animation patterns to be displayed on the next horizontal scanning line and the data representative of the display start positions X of the display elements are sequentially stored in the pattern shift registers and X counters of the animation pattern processing circuits 13. At the same time, the color code of the foreground of each animation pattern is transferred from the fourth byte of the animation control table Ck to each animation pattern processing circuit 13. Then, the next horizontal scanning is started, and each time the count NH of the horizontal counter 7 is incremented by one, the count of each X counter is decremented by one. When the count of each X counter reaches "0", the bits contained in the corresponding pattern shift register are sequentially shifted out one by one in synchronization with the count-up of the horizontal counter 7 so that the dot pattern corresponding to these bits are displayed on the CRT screen in the selected color. In this case, when "1" signal is outputted from the pattern shift register, the animation pattern processing circuit 13 feeds the color code to the color palette circuit 11, so that a display element represented by the "1" signal is displayed on the screen in a color corresponding to this color code. When the output of the pattern shift register is "0", the animation pattern processing circuit 13 does not output the color code but outputs a signal S2 which allows the image data processing circuit 9** to display a display element of the still image. Thus, the display elements of the still image are displayed in the positions corresponding to the background of the animation pattern.

With the above-mentioned conventional display controller, when part of the animation pattern image is hidden on the left side of the screen, the value of X of the display position (X, Y) becomes negative. As a result, even when the count of the X counter is decremented one by one, the count will never reach 0, so that the proper display position of the animation pattern image can not be determined. Therefore, to compensate for this, the screen is shifted left by a predetermined number "m" of display elements (for example, m=32) to provide an imaginary screen as shown by a broken line in FIG. 5, and the counting of the X counter is started from the left end of this imaginary screen so as to shift the position (X, Y) on the imaginary screen to the position (X−m, Y) on an actual screen, so that the animation pattern image displayed on the screen is shifted left by "m" display elements. This is effected by the bit data EC in the animation pattern control table Ck. More specifically, when the bit data EC is "1", the count-down of the X counter is started earlier by count "m" to effect the above operation. With this method, the above-mentioned disadvantages can be eliminated, but since the count-down of the X counter must be started earlier by count "m", the data required must be loaded into the X counter and pattern shift register of each animation pattern processing circuit 13 before the count-down of the X counter is started. And, the time available for the loading of the data into the animation pattern processing circuit 13 during the horizontal non-display period is much shortened accordingly. For example, when magnifying an animation pattern of 16×16 display elements twice, the pattern image must be shifted by 32 display elements, in which case more than one thirds of the horizontal non-display period is used by this shifting, this horizontal non-display period corresponding to 85 count between count 256 and count 340 of the horizontal counter 7. As a result, the data which can be loaded into each animation pattern processing circuit 13 is reduced, so that the number of the animation patterns which can be displayed on one horizontal scanning line is reduced.

There have also been proposed display controllers of the types shown in U.S. Pat. Nos. 4,262,302, 4,286,320 and 4,374,395, however none of them have overcome the above-described deficiencies of the conventional controllers.

SUMMARY OF THE INVENTION

It is therefore an object of the present invention to provide a video display controller by which multi-color animation patterns can be displayed on a screen.

It is another object of the present invention to provide a video display controller by which an overlapping portion of animation patterns can be displayed in a color which is obtained by effecting a certain operation on color codes of the animation patterns.

It is a further object of the present invention to provide a video display controller by which the position on the screen at which a collision of one animation pattern with another can be detected.

It is a further object of the present invention to provide a video display controller in which a collision of one animation pattern with another can selectively be detected.

It is a further object of the present invention to provide a display controller of the type by which an increased number of animation patterns can be displayed on one horizontal scanning line of the screen.

According to a first aspect of the present invention, there is provided a video display control system for displaying a video image on a screen of a video display unit comprising (a) memory means for storing (i) animation pattern data which represents an animation pattern composed of a predetermined number of pattern elements each corresponding to at least one of display elements on the screen, the pattern elements being divided into at least two pattern element groups, (ii) display position data specifying a display position which is a position on the screen, and (iii) at least two color data specifying colors corresponding respectively to the pattern element groups; and (b) display control means which comprises (I) reading means for reading the animation pattern data, the display position data and the color data from the memory means, and (II) displaying means for displaying an animation pattern image corresponding to the animation pattern at the display position on the screen in the colors in accordance with the animation pattern data, the display position data and the color data read from the memory means, the animation pattern image being divided into at least two image parts corresponding respectively to the pattern element groups and each of the image parts being displayed in corresponding one of the colors.

According to a second aspect of the present invention, there is provide a video display control system for displaying a video image on a screen of a video display unit comprising (a) memory means for storing (i) first to Nth ($N \geqq 2$) animation pattern data each representing an animation pattern composed of a predetermined number of pattern elements, each of the pattern elements corresponding to at least one of display elements on the screen, (ii) first to Nth display position data which specify first to Nth display positions, respectively, each of which is a position on the screen, and (iii) first to Nth color data specifying first to Nth colors, respectively; and (b) display control means which comprises (I) reading means for reading the first to Nth animation pattern data, the first to Nth display position data and the first to Nth color data from the memory means, (II) processing means for receiving the first to Nth animation pattern data, the first to Nth display position data and the first to Nth color data read from the memory means and for outputting the first to Nth color data in accordance with the first to Nth animation pattern data, respectively, and (III) operation means for receiving the first to Nth color data outputted from the processing means and for effecting, when the processing means outputs at least two color data among the first to Nth color data with respect to same display element on the screen, a certain operation on the at least two color data to supply the operation result as a new color data to the video display unit.

According to a third aspect of the present invention, there is provided a video display control system for displaying a video image on a screen of a video display unit comprising (a) memory means for storing (i) first to Nth ($N \geqq 2$) pattern composed of a predetermined number of pattern elements, each of the pattern elements corresponding to at least one of the display elements on the screen, (ii) first to Nth display position data representing first to Nth display positions each of which is a position on the screen; and (b) display control means which comprises (I) reading means for reading the first to Nth animation pattern data and the first to Nth display position data from the memory means (II) processing means for receiving the first to Nth animation pattern data and the first to Nth display position data and for serially outputting each of first to Nth pattern element data by which the first to Nth animation pattern data are constructed, respectively, each of Kth ($1 \leqq K \leqq N$) pattern element data corresponding to one of pattern elements of the animation pattern corresponding to the Kth animation pattern data, and (III) detection means for receiving the first to Nth pattern element data serially outputted form the processing means and for detecting the fact that at least two pattern element data are outputted with respect to the same display element on the screen from the processing means to output a detection signal.

According to a fourth aspect of the present invention, there is provided a video display control system for use with a video display unit having a screen which provides, in accordance with a clock signal synchronized with vertical and horizontal synchronization signal, a plurality of columns of and a plurality of rows of display elements on the screen each for displaying in a designated color, the video display control system comprising (a) memory means for storing (i) animation pattern data representing an animation pattern composed of at least one row of a predetermined number of pattern elements, each of the pattern element corresponding to at least one of the display elements, (ii) display position data specifying a display position which is a position on the screen; and (b) display control means which comprises (I) horizontal counter means responsive to the clock signal for generating a horizontal count representative of a current horizontal display position of display element on the screen, (II) reading means for reading the animation pattern data and the position data from the memory means, (III) shift register means composed of a predetermined number of stages for storing pattern element data representative of pattern elements which correspond to a row of the animation pattern, each stage of the shift register means having an output terminal, (IV) start signal generating means for generating a start signal by comparing the horizontal count with the display position data, (V) clock signal feeding means responsive to the start signal for feeding the clock signal to the shift register means, and (VI) selecting means responsive to the start signal for selecting one of the output terminals of the shift register means in accordance with the position data and a predetermined number of display elements by which the animation pattern on the screen is to be shifted, the shift register means feeding pattern element data derived from the selected output terminal to the video display unit.

BRIEF DESCRIPTION OF THE DRAWINGS

FIG. 3-(*b*) is an illustration of one example of the animation patterns of FIG. 3-(*a*);

FIG. 4-(*b*) is an illustration showing one of the animation pattern control tables stored in the animation pattern control table area 5*e;*

FIG. 8-(*b*) is an illustration showing one of the animation pattern control tables stored in the animation pattern con area 5*e* shown in FIG. 8-(*a*);

FIG. 9-(*b*) is an illustration showing one of the animation pattern color tables shown in FIG. 9-(*a*);

FIG. 17-(*b*) is an illustration showing one of the animation pattern control tables stored in the animation pattern control table area 5*e* shown in FIG. 17-(*a*);

FIG. 18 is an illustration showing the relationship of the color codes, color data and colors;

DESCRIPTION OF THE PREFERRED EMBODIMENTS OF THE INVENTION

Figure 7:
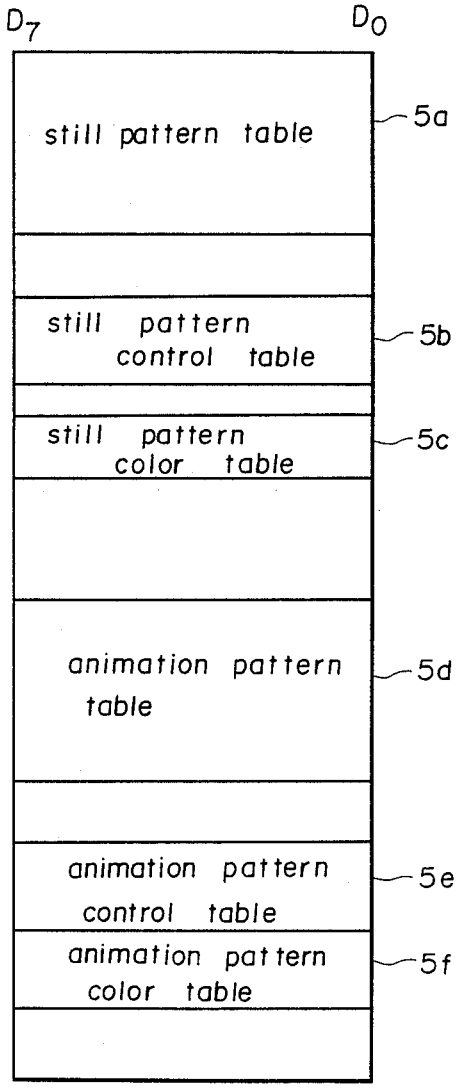
FIG. 7 is a memory map of a VRAM 5 in a video control system provided in accordance with the present invention.
Figure 8:
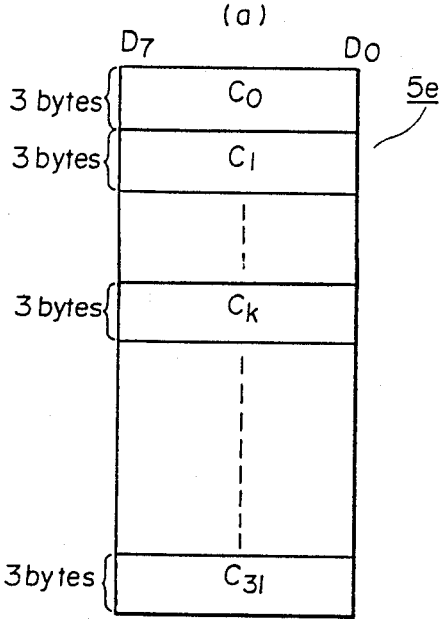
FIG. 8-(*a*) is an illustration showing the animation pattern control table area 5*e* of the video display controller provided in accordance with the present invention.
Figure 8:
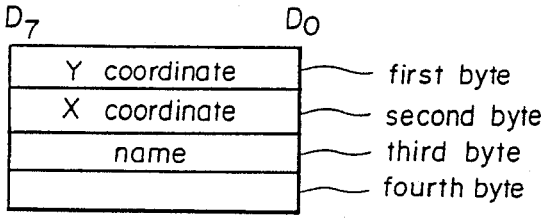
Figure 9:
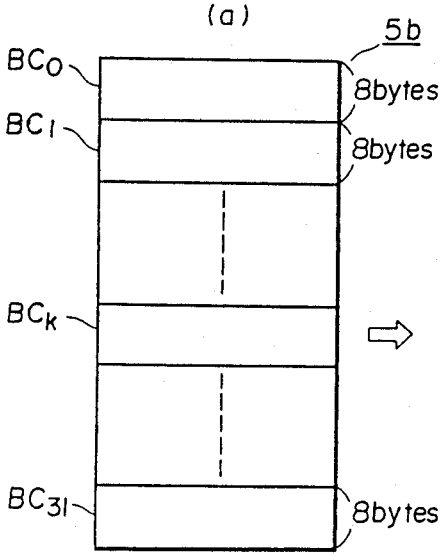
FIG. 9-(*a*) is an illustration showing the animation pattern color tables stored in the animation pattern color table area of 5*f* of FIG. 7.
Figure 9:
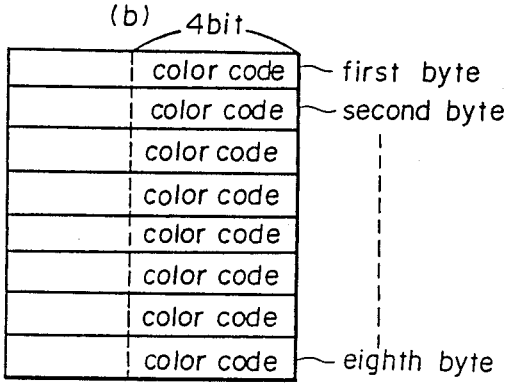

A video display control system shown in FIGS. 7 to 12 differs from the video display control system of FIGS. 1 to 4 in the following respects. A VRAM 5 in this video display control system further comprises, as shown in FIG. 7, an animation color table area 5*f* for storing a plurality of color codes with respect to each animation pattern so that each animation pattern can be displayed in a plurality of colors. An animation pattern control table area 5*e* of the VRAM 5 including thirty two animation pattern control tables C0 to C31 as that of the conventional video display controller. However the fourth byte of each animation pattern control table Ck is not used, as shown in FIGS. 8-(*a*) and 8-(i b). The animation color table area 5*f* stores 32 memory blocks BC0 to BC31, each composed of eight bytes, as shown in FIG. 9-(*a*), the memory blocks BC0 to BC31 corresponding to the animation pattern control tables C0 to C31, respectively. The lower four bits of the first to eighth bytes of each of the memory blocks BC0 to BC31 store color codes representative of colors of the first to eight rows of display elements of the corresponding animation pattern. More specifically, display elements in the first row of an animation pattern, which are represented by bits "1" of the first byte of the corresponding animation pattern, are displayed in a color designated by a color code stored in the first byte of the corresponding memory block in the animation color table 5*f*. Similarly, display elements in the second to eight rows of the animation pattern are displayed respectively in colors designated by color codes stored in the second to eight bytes of the corresponding memory block in the animation color table 5*f*.

Figure 10:
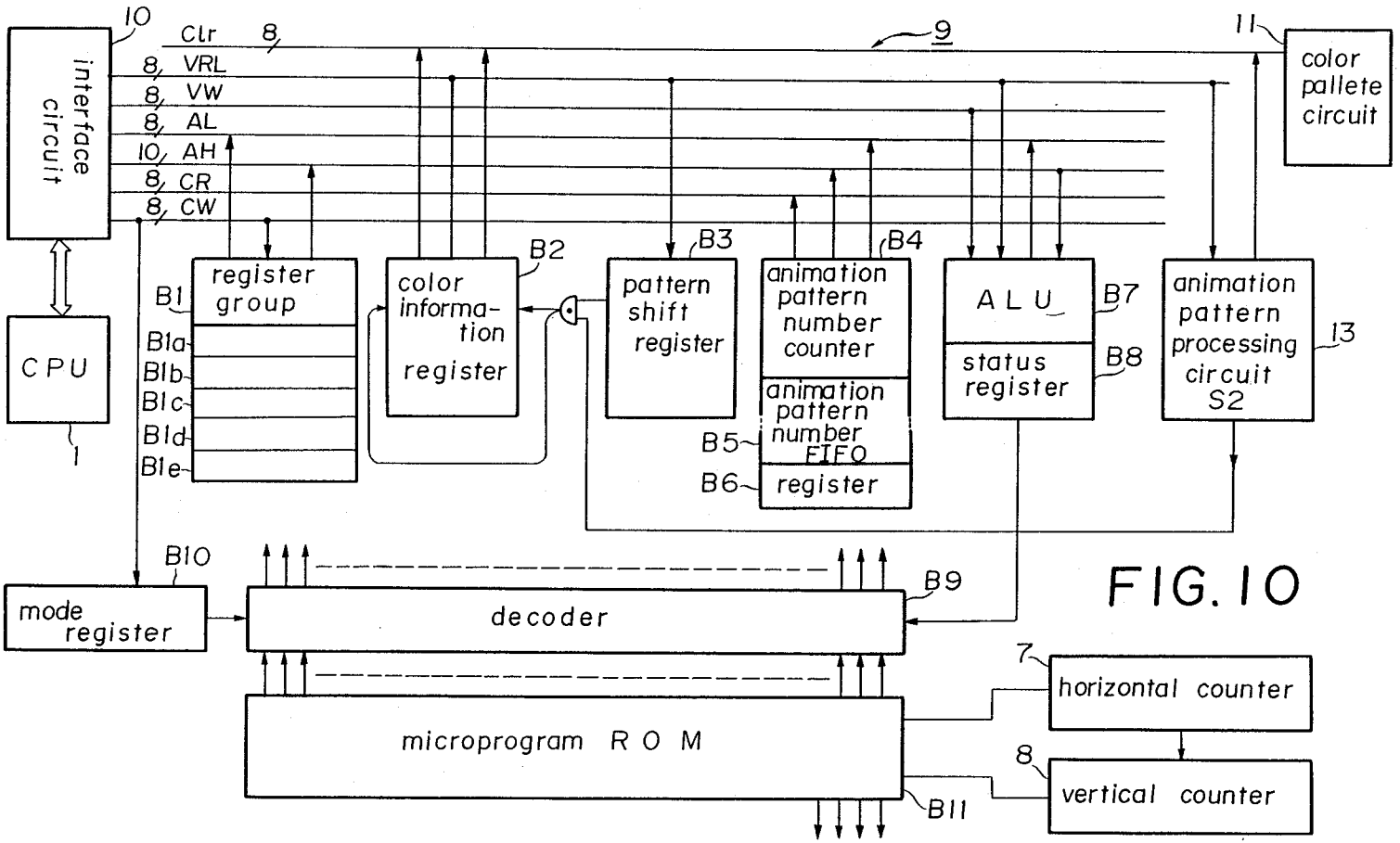
FIG. 10 mainly shows a block diagram of the image data processing circuit 9 of the video display controller provided in accord the present invention.

FIG. 10 shows a block diagram of an image data processing circuit 9 of this video display controller. A bus CW (8 bits) is used for writing data fed from a CPU 1, and a bus CR (8 bits) is used for loading data into the CPU 1. A bus AH (10 bits) and a bus AL (8 bits) forms an address bus for designating addresses of the VRAM 5, the bus AH being the upper 10 bits of the address bus and the bus AL being the lower 8 bits thereof. A bus VW is used for writing data into the VRAM 5, and a bus VRL is used for reading data from the VRAM 5. A bus Clr is used for transferring color codes and is connected to a color palette circuit 11.

A register group B1 comprises registers B1*a* to B1*e* for storing data representative of the start addresses of the still pattern control table area 5*b*, still pattern color table area 5*c*, still pattern table area 5*a*, animation pattern control table 5*e* and animation pattern table 5*d*, respectively. Data representative of other addresses of these tables replace the respective start address data under the control of the CPU 1 via the bus CW. A color information register B2 stores two kinds of still pattern color codes read from the still pattern color table area 5*c* and selectively outputs one of these color codes onto the color bus Clr in accordance with the state ("1" or "0") of an output signal of a pattern shift register B3. The pattern shift register B3 converts parallel data, which is representative of the dot pattern of a row of display elements of a still pattern read from the VRAM 5 via the bus VRL, to serial data and feeds it to the color information register B2 to determine the color to be outputted to the color palette circuit 11.

Figure 4:
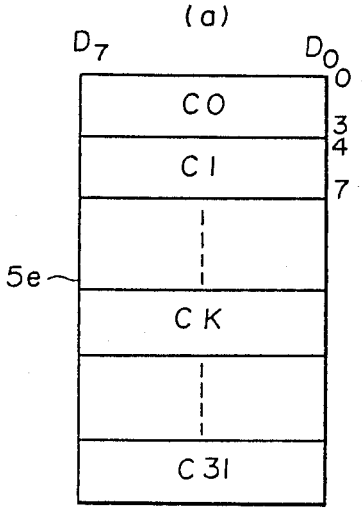
FIG. 4-(*a*) is an illustration showing the animation pattern control table area 5*e* in which animation pattern control tables C0 to C31 are stored.
Figure 4:
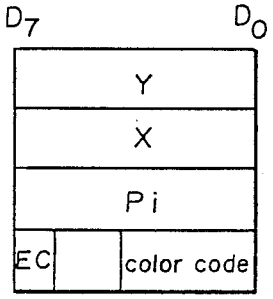
Figure 5:
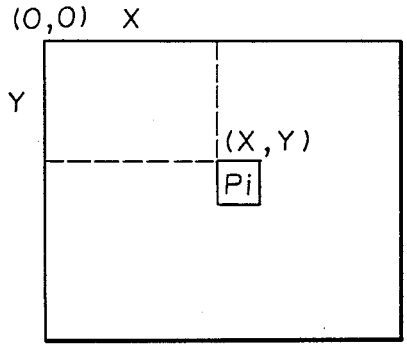
FIG. 5 is an illustration showing an animation pattern Pi displayed at a display position defined by X and Y coordinates (X,Y) on the screen.
Figure 6:
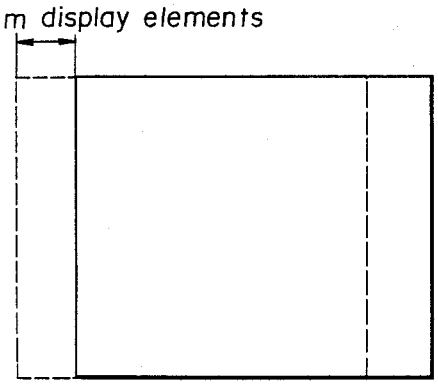
FIG. 6 is an illustration showing the actual display screen and an imaginary screen shifted left by "m" display elements with respect to the actual display screen.

An animation pattern number counter B4 is a 7-bit counter which stores data representative of the number k (animation pattern number) of each animation pattern control table Ck and data representative of that address (1st byte in this embodiment) of the table Ck (FIG. 4-(*b*)) in which the Y coordinate is stored. In this case, the upper 5 bits of the counter B4 represent the animation pattern number while the lower 2 bits designate respectively the Y coordinate, the X coordinate and the pattern name by the states "00", "01" and "11". When the animation pattern table 5*e* is searched to determine the animation patterns to be displayed on the next horizontal scanning line, the animation pattern number k is sequentially incremented in the animation pattern number counter B4. At this time, the lower 2 bits are always "0" states and designate only the Y coordinates stored in the animation pattern table 5*e*. This search checks the Y coordinate of each animation pattern control table Ck during the display period and compares it with the count NV of the vertical counter 8. When the animation pattern to be displayed is found, the contents of the animation pattern number counter B4 is loaded into an animation pattern number first-in first-out memory (FIFO) B5. In this case, the animation pattern numbers k (0 to 31) are stored from the smallest one, and when the animation pattern number FIFO B5 stores up to 8 animation pattern numbers, it will refuse a further loading of the animation pattern number thereinto. Thus, during the horizontal display period, after up to 8 data representative of animation pattern numbers of the animation pattern images to be displayed on the next horizontal scanning line are stored in the FIFO B5, these are sequentially read therefrom during the horizontal non-display period and used as address data for reading from the animation pattern control table Ck the data representative of the Y and X coordinates, names, EC bits and color codes of the animation patterns to be displayed. Then, the data read from each animation pattern control table Ck are fed via the bus VRL to an animation pattern processing circuit 20 and are loaded thereinto, eight circuits 20 being provided as later described. The detected ninth animation pattern number which is not loaded into the animation pattern number FIFO B5 is loaded into a register B6.

ALU (arithmetic and logic unit) B7 compares the count NV of the vertical counter 8 with each Y coordinate, and effects address calculation of the animation pattern, and the results of these calculations are fed to a decoder B9 via a status register B8. In accordance with an output of a mode register B10 the decoder B9 decodes instructions fed from a microprogram ROM B11 and effects a sequential control of the data to be fed to the buses. The horizontal and vertical counters 7 and 8 are connected to the microprogram ROM B11 to address it to read the instructions therefrom.

The animation pattern processing circuit 13 will now be described in more detail.

Figure 11:
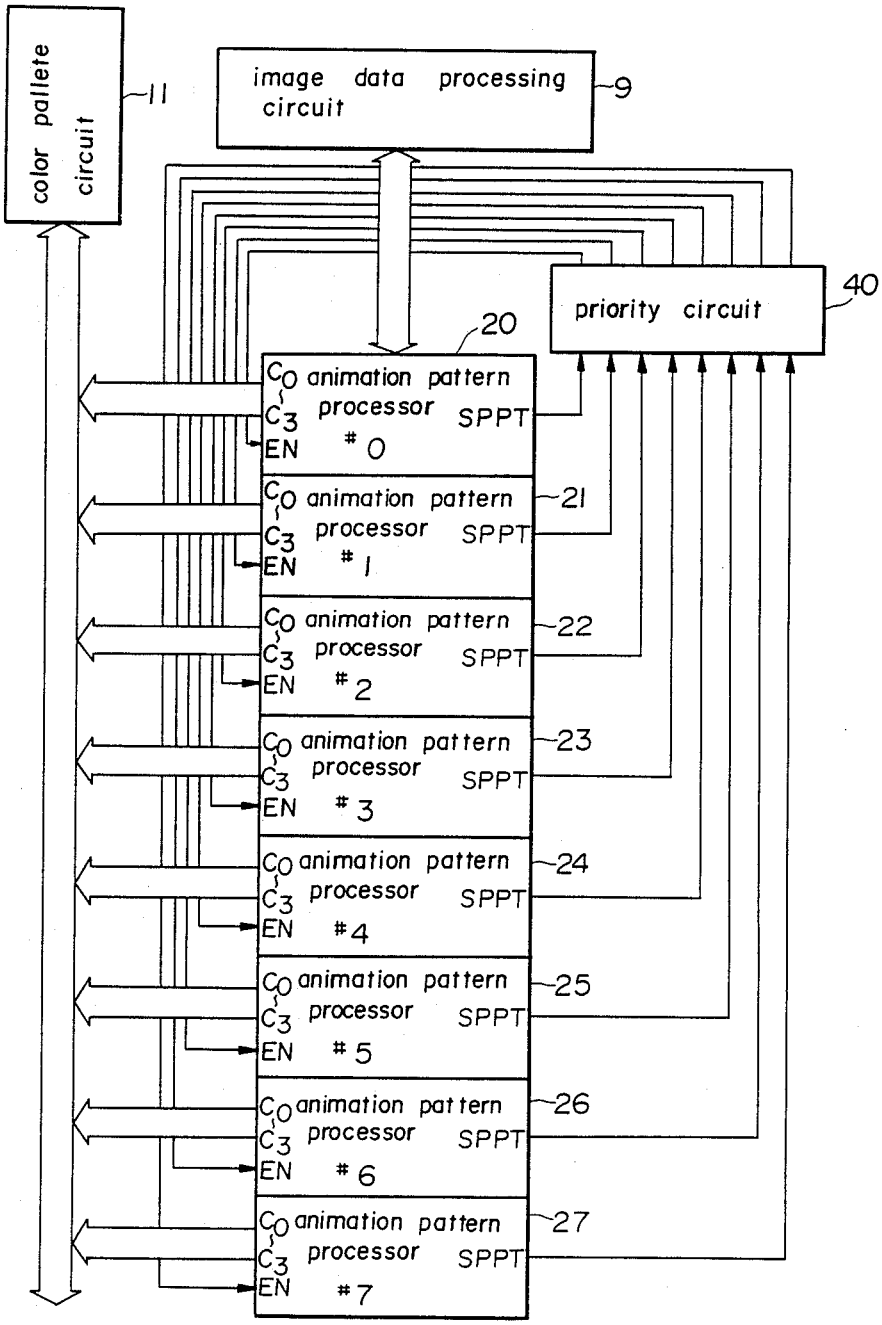
FIG. 11 is a block diagram of the main portion of the video display controller.
Figure 12:
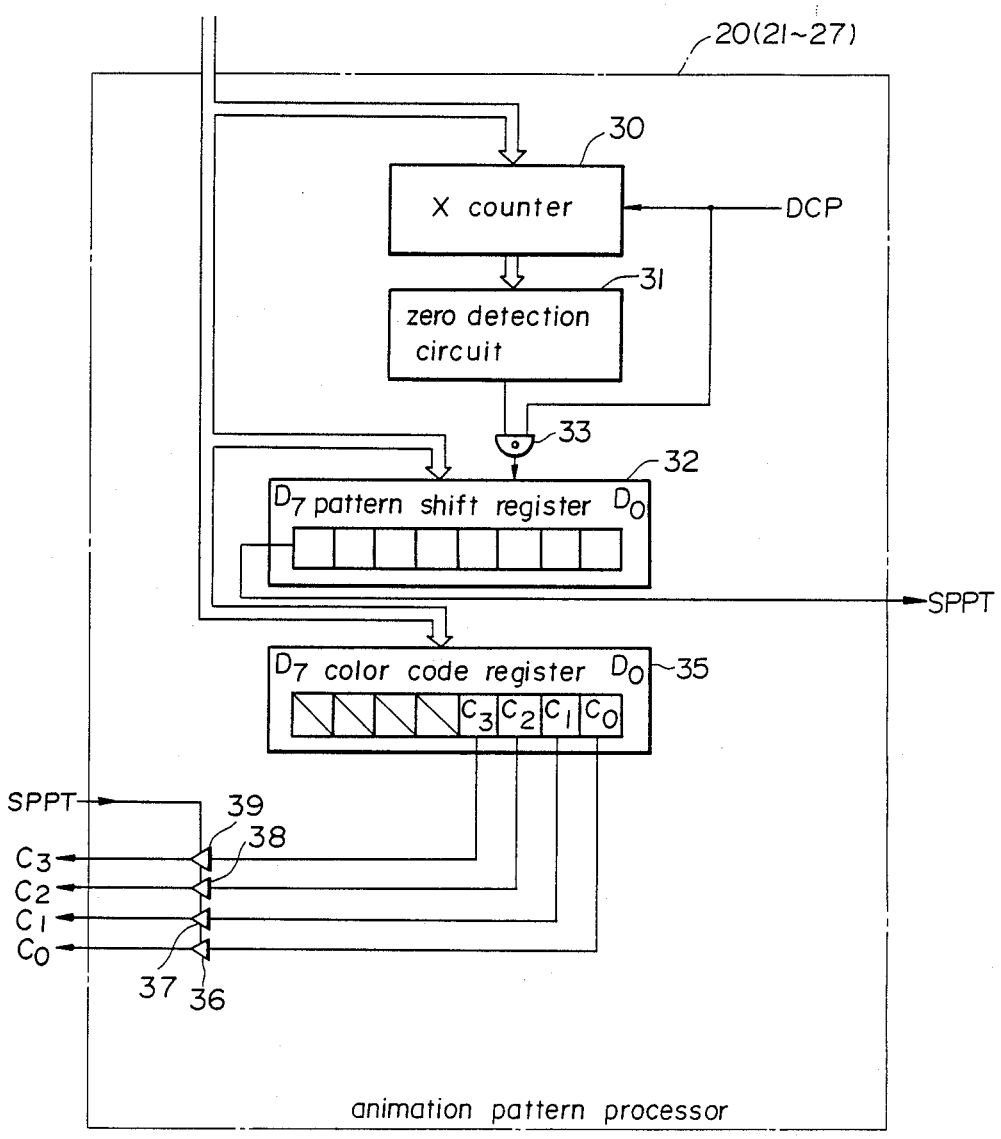
FIG. 12 is a block diagram of one of the animation pattern processor of the video display controller.

FIG. 11 shows a block diagram of the animation pattern processing circuit 13. The animation pattern processing circuit 13 includes eight animation pattern processors 20 to 27 of an identical construction into which data representative of the animation pattern are loaded, respectively, from VRAM 5 via the image data processing circuit 9. FIG. 12 shows a block diagram of one of the animation pattern processors 20 to 27. Data representative of the X coordinate is transferred from the second byte of each animation pattern control table Ck (k=0 to 31) to X counter 30, and the X counter 30 counts down its contents representative of the X coordinate data in accordance with dot clock pulses DCP produced in synchronization with the timings of sequential display of the display elements during the horizontal scanning. A zero detection circuit 31 outputs "1" signal when the count of the X counter 30 reaches "0". Data (1-byte) in that address of the animation pattern table area 4*d* designated by a processing as later described is transferred to a pattern shift register 32. The bits of the pattern shift register 32 representative of dot pattern of a row of display elements of the animation pattern are shifted out one by one from its MSB (D7) in accordance with the dot clock pulses DCP applied thereto via an AND gate 33. The output signal of the pattern shift register 32 is fed as a pattern signal SPPT. The data in the fourth byte of each animation pattern control table Ck is loaded into a color code register 35. In this case, the first to fourth bits C0 to C3 of each color code are loaded into the 1st to 4th bits of the register 35, respectively. The outputs of the 1st to 4th bits of the register 35 are fed to tri-state buffers 36 to 39, respectively. Each of the tri-state buffers 36 to 39 is enabled to output the inputted color code when the corresponding pattern signal SPPT of "1" is applied via a priority circuit 40 (FIG. 11) thereto, and is rendered a high impedance output condition when the pattern signal SPPTT is "0". The priority circuit 40 gives the highest priority to the pattern signal SPPT outputted from the animation pattern processor 20, . . . , and the lowest priority to the animation pattern processor 27. Thus, the priority circuit 40 outputs only one pattern signal SPPT, which has higher priority to other pattern signals SPPT simultaneously supplied thereto, to the corresponding animation pattern processor.

The operation of the video display controller in this embodiment will now be described.

Figure 13:
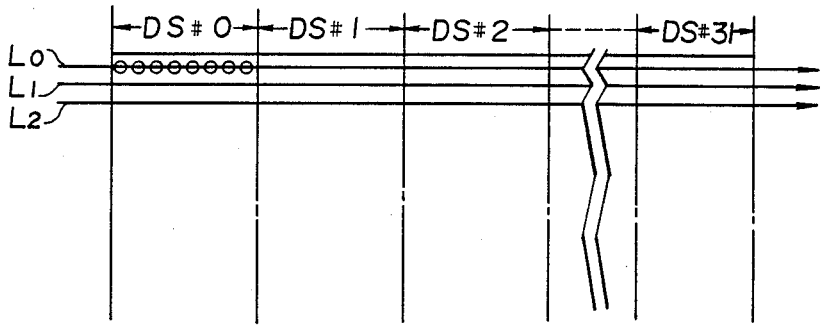
FIG. 13 is an illustration showing the relation between the scanning lines on the screen and the display sections DS#0, DS#1, DS#2, . . . DS#31.

FIG. 13 is a diagrammatical illustration showing the relation between the display screen and a beam of electrons scanning the screen. The screen is divided horizontally into display sections DS#0 to DS#31. Each display section has eight display elements on one horizontal line. During the time when these eight display elements are displayed, the image data processing circuit 9 makes access to VRAM 5 five times. Out of the five accesses, four accesses are used for the still pattern display and other display processing, and one access is used for the animation pattern display. In this case, the data representative of the still pattern to be displayed at the display section prior to that in which this still pattern is to be displayed.

Figure 14:
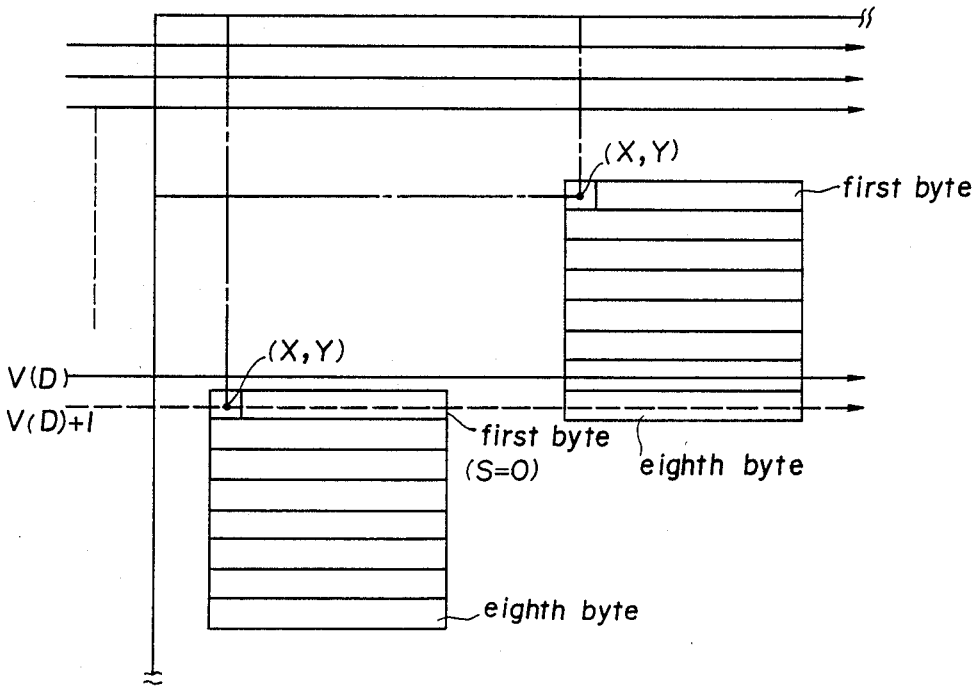
FIG. 14 is an illustration showing the relation between the output of the counter and the display positions of the rows of an animation pattern.

The access operation for the animation pattern processing will now be described. When the beam of electrons is scanning the screen along the line L0 at the display section DS#0, the image data processing circuit 9 checks whether there is any animation pattern, designated by the animation pattern control table C0 (FIG. 8), to be displayed on the line L1 which is one line below the line 10. More specifically, access is made to the first byte of the animation pattern control table C0 so that the image data processing circuit 9 reads the data representative of the Y coordinate and determines whether this Y coordinate satisfies the following formula:

$$(V(D)+1)-Y(D)=S \quad (1)$$

wherein Y(D) and V(D) are the Y coordinate and the output of the vertical counter 8 (the number of the current scanning line). The formula (1) is provided on the condition that the number of the uppermost scanning line is 0. In this embodiment, lines L0 to L191 ($0 \leqq V(D) \leqq 191$) are displayed in the display area of the screen. Actually, however, the checking through the formula (1) is started when the scanning is effected along the line ($V(D)=-1$) one line above the line L0. As shown in FIG. 14, when the value S is "0" the first row of an animation pattern, which is represented by the first byte of the corresponding animation pattern data, is to be displayed on the next scanning line, and when the value S is "7", the eighth row of an animation pattern, which is represented by the eighth byte of the corresponding animation pattern data, is displayed on the next scanning line. Thus, when the formula (1) is satisfied, it is determined that the animation pattern to be displayed exists.

Next, during the time when the scanning is being effected along the line L0 at the next display section DS#1, the image data processing circuit 9 checks whether there is any animation pattern, designated by the animation pattern control table C1, on the line L1. Then, similarly, it is checked whether there are any animation patterns designated respectively by the animation pattern control tables C2 to C31 during the scanning at the display sections DS#2 to DS#31. Thus, during the scanning along the line L0 throughout the display sections DS#0 to DS#31, the image data processing circuit 9 sequentially accesses the first bytes of the animation pattern control tables C0 to C31 to determine whether there is any animation pattern on the next line L1. In this case, however, when it is detected that up to 8 animation patterns to be displayed exist on that line, any further animation pattern on that line is ignored. Therefore, when the scanning along one line is completed, the maximum of 8 animation patterns on the next line can be detected. During the horizontal non-display period, the image data processing circuit 9 processes the data representative of the animation patterns so detected. Assuming that the animation patterns designated by the animation pattern control tables C0 to C7 are detected to be displayed on the next line (in which case the animation pattern designated by any one of animation pattern control tables C8 to C31 is ignored), the image data processing circuit 9 first transfers the X coordinate in the second byte of the animation pattern control table C0 to the X counter 30 of the animation pattern processor 20. Then, the image data processing circuit 9 reads the pattern name data from the third byte of animation pattern control table C0, and in accordance with this pattern name and the value S, accesses that address of the animation pattern table area 5*d* storing the data representative of the animation pattern to be displayed so as to transfer this animation pattern data of 1 byte to the pattern shift register 32 of the animation pattern processor 20. Also, the image data processing circuit 9 accesses the memory block BC0 of the animation pattern color table area 5*f* and transfers a color code contained in a byte of the memory block BC0, which is designated by the value S, to the color code register 35 of the animation pattern processor 20. For example, when the value S is "1", the image data processing circuit 9 reads the data contained in the second byte of the memory block BC0 and transfers it to the color code register 35.

Then, similarly, the image data processing circuit 9 performs the processing relating to the animation pattern control tables C1 and C7. The foregoing processings are carried out by the image data processing circuit 9 during the horizontal non-display period.

The scanning along the next line after the horizontal non-display period will now be described.

It is assumed that the count of the X counter 30 of the animation pattern processor 20 is "5". First, when the electron beam enters the display section DS#0 on the line L1, the X counter 30 counts down the dot clock pulses DCP in synchronization with the time interval at which the display elements are sequentially displayed on the screen from a left side thereof. As a result, the contents of the X counter 30 is decremented to "0" five counts later, so that the zero detection circuit 31 outputs "1" signal to enable the AND gate 33. Therefore, the dot clock pulses DCP are supplied to the pattern shift register 32 via the AND gate 33, and the pattern shift register 32 sequentially shifts out the data from its MSB in synchronization with the dot clock pulses DCP. Therefore, the pattern signal SPPT is outputted from the pattern shift register 32 in synchronization with the timing at which the sixth display element (which corresponds to the value 5 of the X coordinate) counting from the left end of the screen is displayed. Thus, the time when the pattern signal SPPT beings to be outputted is determined by the X coordinate data loaded in the X counter 30. The pattern signal SPPT is a serial pulse signal derived from the parallel data and represents the animation pattern.

The thus outputted pattern signal SPPT is supplied to the tri-state buffers 36 to 39 to enable or inhibit the application of the color code contained in the color code register 35 to the color palette circuit 13.

The above described operation is repeatedly carried out to display each row of display elements of the animation pattern on the screen. Consequently, the animation pattern represented by the dot pattern data in the animation pattern table area 5d, which is designated by the name in the animation pattern control table Ck, is displayed on the screen at the position, defined by the X and Y coordinates in the animation pattern control table Ck, in colors designated by the color codes contained in the memory block BCk. And in this case, each of the first to eighth rows of display elements of the animation pattern is displayed in a respective one of the colors designated by the first to eighth color codes in the memory block BCk. Thus each animation pattern can be displayed in a plurality of colors.

Figure 15:
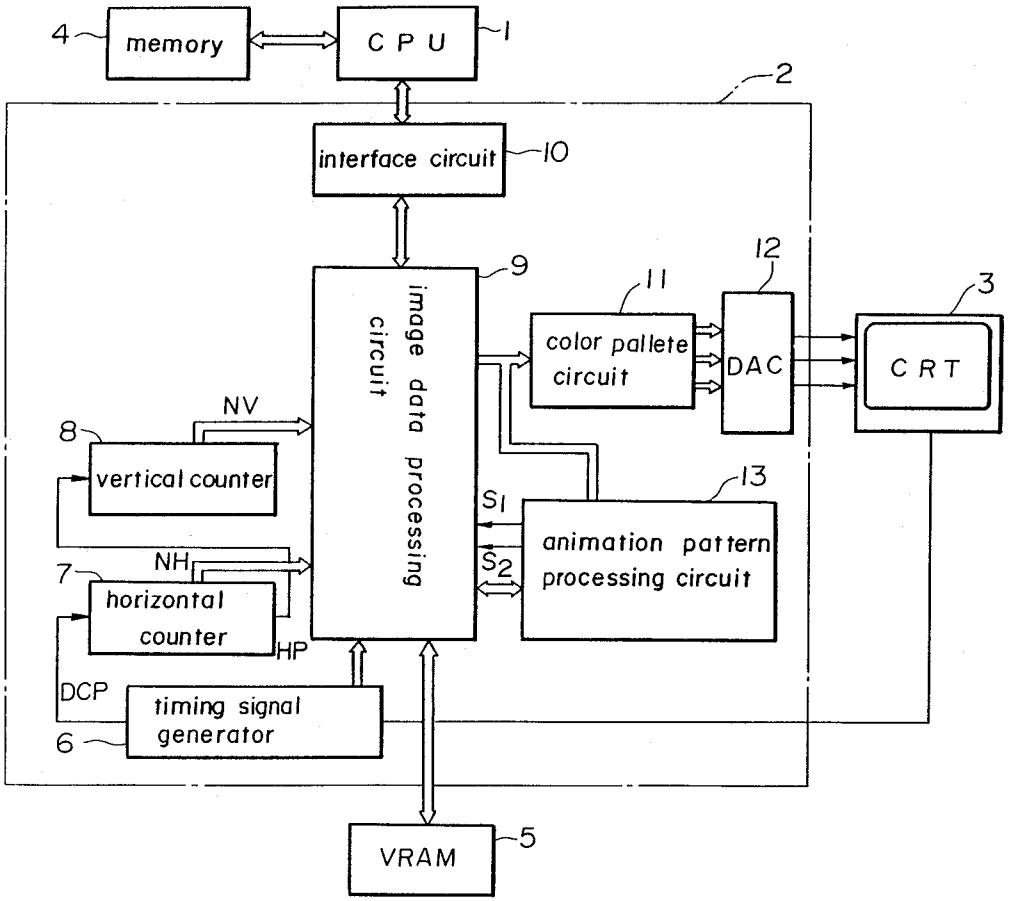
FIG. 15 is a block diagram of a modified video display controller and a modified video display control system including it.
Figure 16:
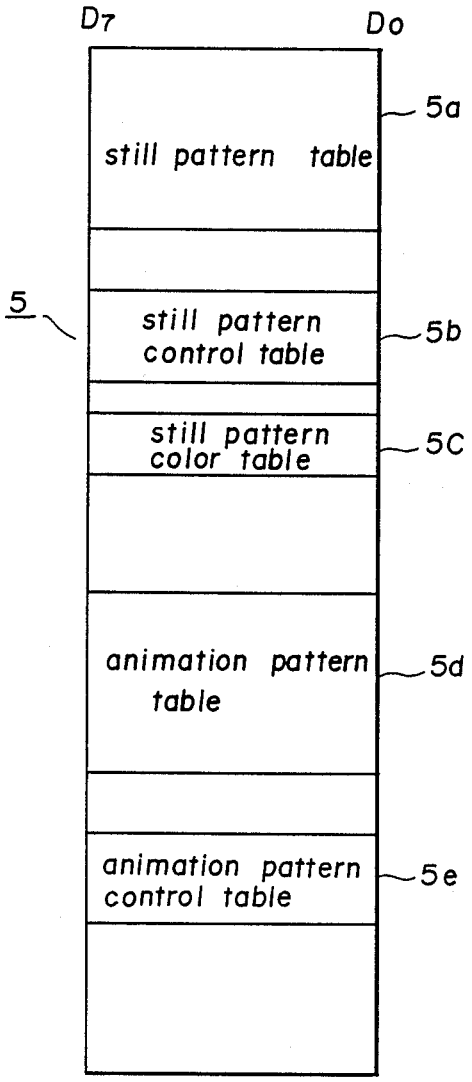
FIG. 16 is a memory map of a VRAM 5 in the modified video display control system.
Figure 17:
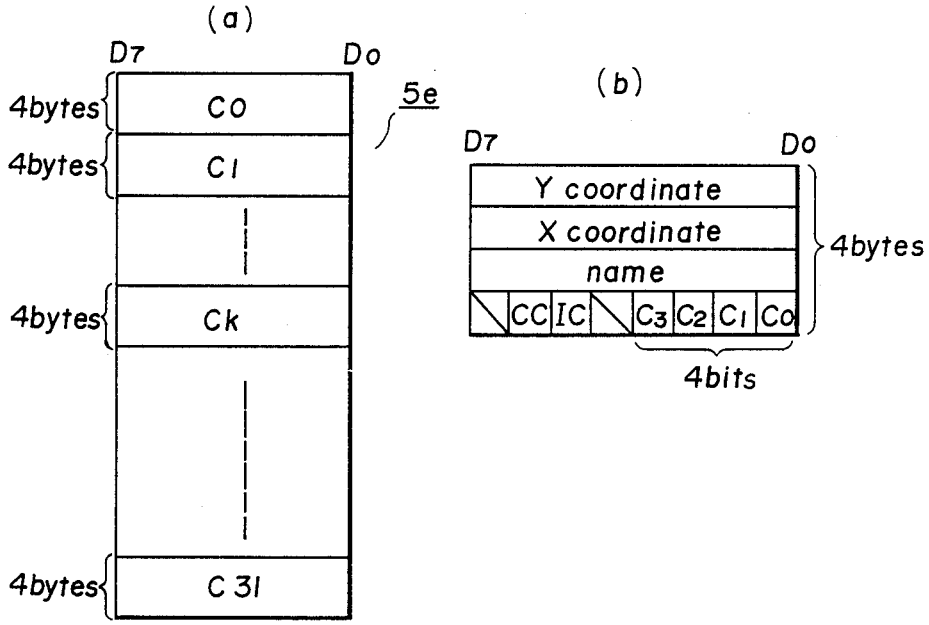
FIG. 17-(*a*) is an illustration showing the animation pattern control table area 5*e* of the modified video display controller.

FIG. 15 shows a block diagram of a modified video display control system which is capable of mixing colors of overlapping portions of a plurality of animation patterns and is also capable of detecting a collision of animation patterns. A VRAM 5 of this video display control system differs from the aforesaid video display control system in that it has no animation pattern color table area (FIG. 16) and that the fourth bytes of each animation pattern control table Ck is used for storing a color code and a pair of bit data IC and CC (FIG. 17-(*b*)). The color code stored in the lower four bits of the fourth byte of each animation pattern control table Ck designates a color of the corresponding animation pattern. The relationship of the color codes and display colors is shown in FIG. 18. And the bit data IC and CC stored respectively in the sixth and seventh bits of each animation pattern control table Ck determine the animation pattern processing mode as later described. An animation pattern processing circuit 15 of this video display controller detects a collision between animation pattern images on the screen, and feed a collision signal S1 in the "1" state to an image data processing circuit 9 when such a collision is detected.

The animation pattern processing circuit 13 will now be described in more detail.

Figure 19:
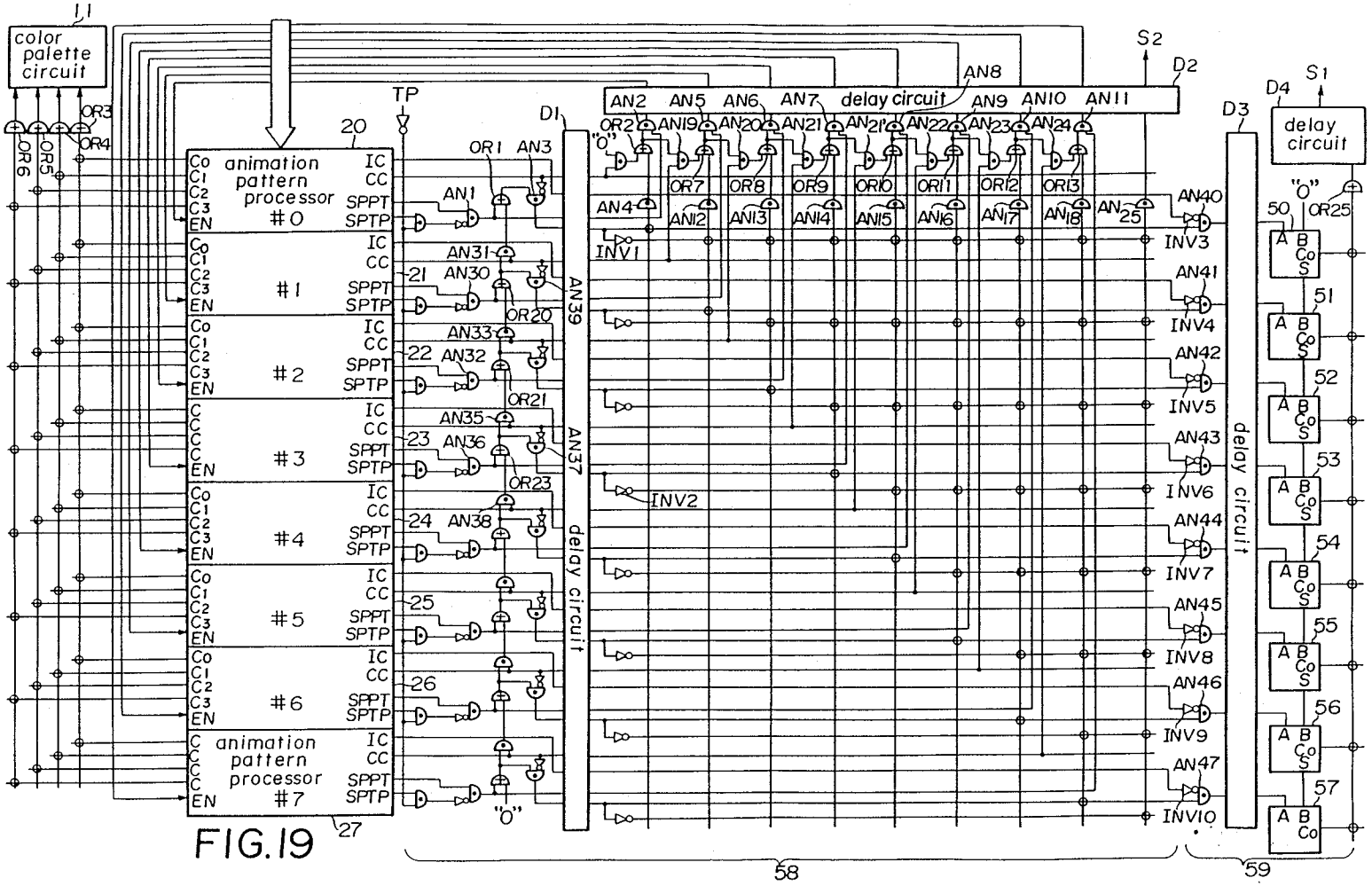
FIG. 19 is a block diagram of the main portion of the modified video display controller.
Figure 20:
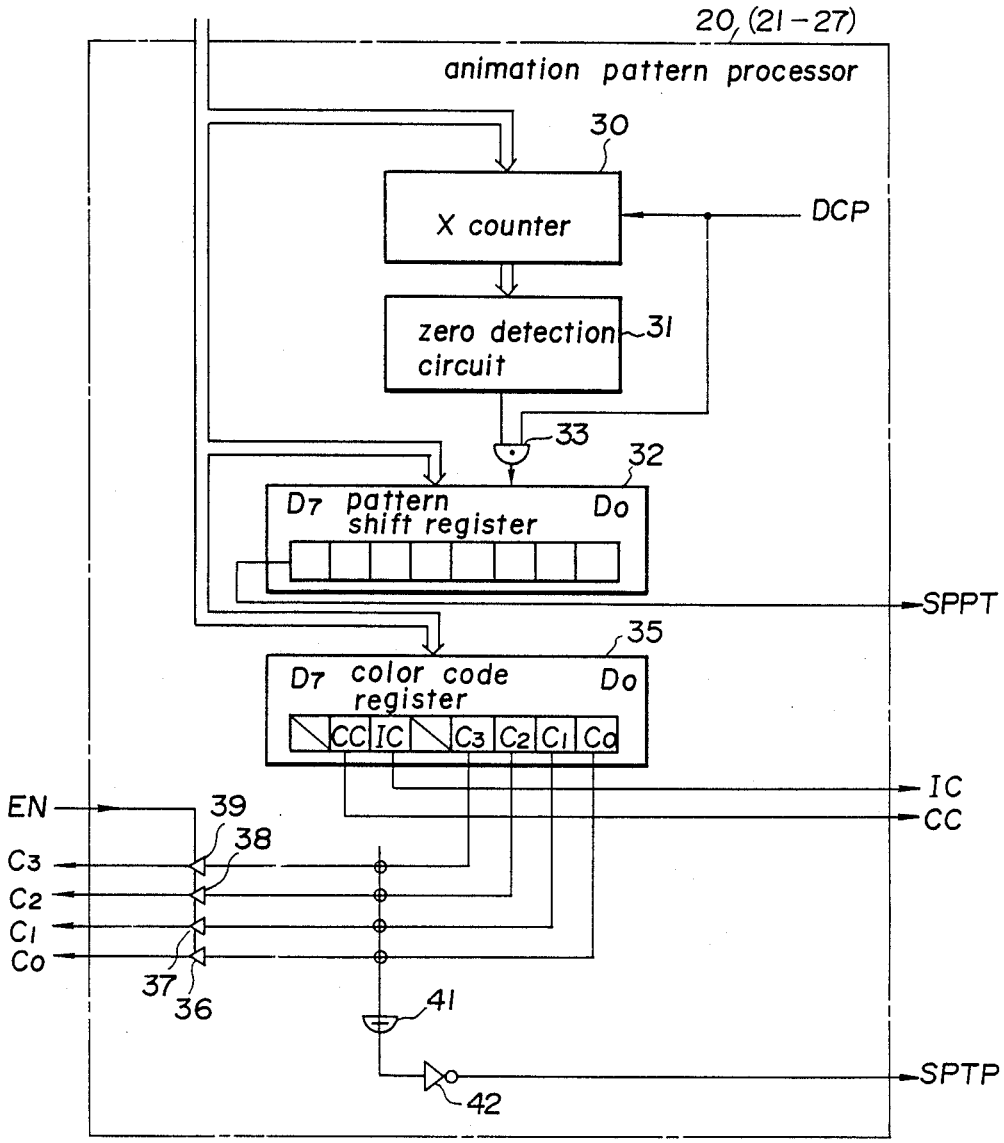
FIG. 20 is a block diagram of one of the animation pattern processors of the modified video display controller.

FIG. 19 shows a block diagram of the animation pattern processing circuit 13. The animation pattern processing circuit 13 includes animation pattern processors 20 to 27 of an identical construction into which data representative of animation pattern images are loaded, respectively, from the VRAM 5 via the image data processing circuit 9. FIG. 20 shows a block diagram of each of the animation pattern processor 20 to 27. As is appreciated from FIG. 20, the animation processors 20 to 27 of this video display controller 2 differ from those shown in FIG. 12 in that each color code register 35 further stores the bit data IC and CC, read from the fourth byte of the corresponding animation pattern control table, in the sixth and seventh bits thereof. The bit data IC and CC are outputted from the color code register 35 as bit signals IC and CC, respectively. The first to fourth bits C0 to C3 of the color code stored in the color code register 35 are subjected to a logical OR operation by an OR gate 41 which outputs a signal SPTP of "1" when the bits C0 to C3 are all "0". The signal SPTP indicates that the color code contained in the color code register 35 represents transparency.

In FIG. 19, gates marked by "·" denote AND gates, and gates marked by "30" denote OR gates. Delay circuits D1 to D4 operate in synchronization with the dot clock pulses DCP applied to the animation pattern processors 20 to 27. Each of adders 50 to 57 has input terminals A and B, a carry output terminal Co and an output terminal S for outputting the addition result. Reference numeral 58 designates a color mixture and priority circuit, and reference numeral 59 designates a collision detection circuit.

The operation of this modified video display controller will now be described, and the animation pattern processing will first be described briefly.

(1) COLOR MIXTURE PROCESSING

Figure 21:
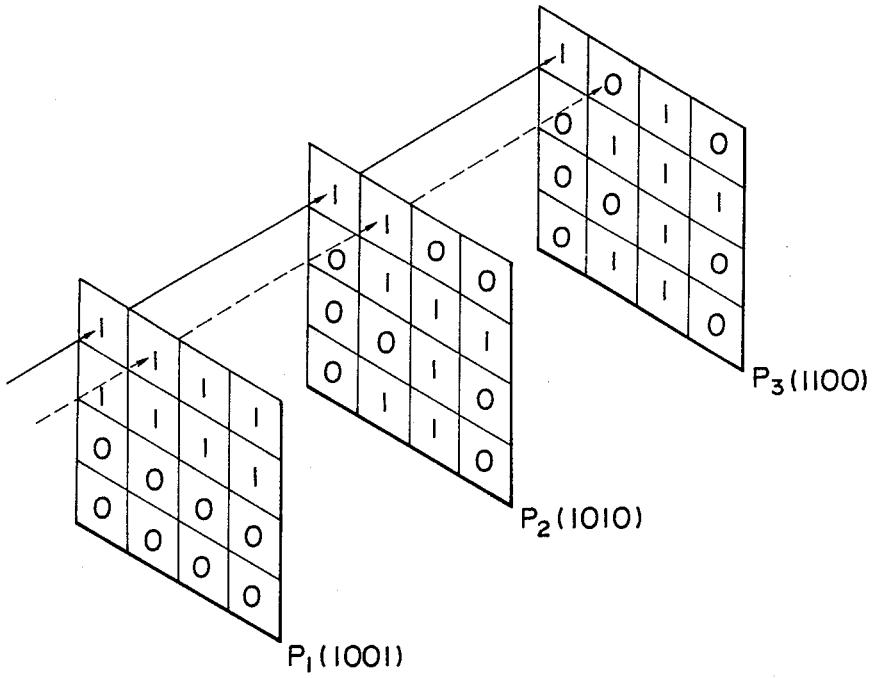
FIG. 21 is an illustration showing three animation patterns overlapping with each other.

According to this processing, when animation pattern images overlap, the logical sum of the color codes of these overlapping pattern images is produced for use as a new color code representative of the color of display elements in such overlapping portions. For example, as shown in FIG. 21, three animation patterns P1, P2 and P3 overlap completely and have the color codes "1001" (blue), "1010" (red) and "1100" (yellow), respectively. For illustration purposes, each animation pattern is shown by 4×4 display elements in FIG. 21. In this case, the bit data representative of the upper left end display element of the three patterns P1 to P3 are all "1", and therefore the three color codes are logically added. As a result, the upper left end display element is displayed in a color represented by color code "1111" (white). Also, the data representative of the display element of the three patterns P1 to P3 disposed next to the upper left end display element in a right-hand direction are "1", "1" and "0", respectively. Therefore, the color code of the animation pattern P3 is not added, so that the display element is displayed in a color represented by color code "1011" (mazenta).

With this color mixture processing, the display elements representing the animation pattern image can be displayed in different colors. When four animation patterns having color codes "1000", "0100", "0010" and "0001", respectively, overlap, the maximum of 16 colors can be displayed on the screen.

(2) COLLISION DETECTION PROCESSING

Figure 22:
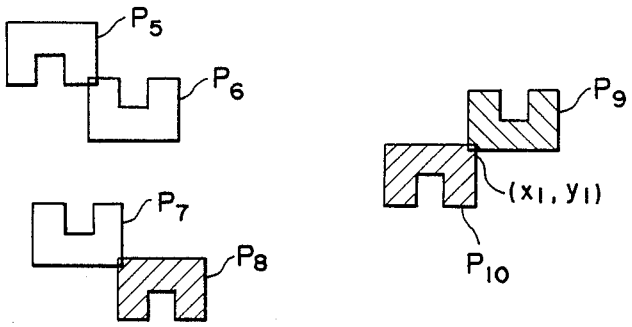
FIG. 22 is an illustration showing six animation patterns P5 to P10 displayed on the screen wherein the collision of the animation pattern P9 with the animation pattern P10 is detected.
Figure 23:
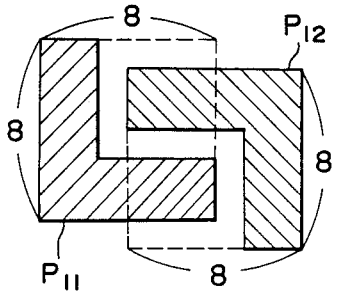
FIG. 23 is an illustration showing two animation patterns P11 and P12 displayed on the screen wherein the animation pattern P11 overlaps the animation pattern P12.

According to this processing, the animation patterns with respect to which the collision detection processing is to be effected are predetermined, and the collision processing is carried out only with respect to those animation patterns, and the coordinates of the display position at which a collision has occurred are detected. For example, in FIG. 22, animation patterns P5, P6 and P7 are not subjected to the collision detection while animation patterns P8, P9 and P10 are subjected to the collision detection. In this case, the collision detection is effected only with respect to the animation patterns P9 and P10, and when the collision is detected, the display position (X1, Y1) of the display element at which the collision develops are detected. When the abovementioned color mixture processing is carried out, this collision detection is not carried out. Also, as shown in FIG. 23, the collision between those portions of animation patterns P11 and P12 which are represented by bit data of "0" are actually not considered as a collision, and the collision detection with respect to such portions is not carried out.

The operation of this modified video display controller will now be described.

During the display period of the display elements on the current scanning line, a detection operation is carried out to determine whether there is any animation pattern whose display elements should be displayed on the next scanning line, as described for the aforesaid video display controller. And as the result of the detection operation, one byte of the pattern data of each of the animation patterns to be displayed on the next scanning line is stored in the pattern shift register 32 of the corresponding one of the animation pattern processors 20 to 27. At the same time, the color code and the bit data IC and CC are read from the corresponding animation pattern control table and stored into the color code register 35.

It is assumed that the bit data CC stored in the color code register 35 of the animation pattern processor 20 is "0" and that the color code is not "0000" which represents transparency. In this case, the animation pattern processor 20 (FIG. 19) outputs the pattern signal SPPT which is either "0" or "1" depending on the animation pattern concerned. This pattern signal SPPT is fed to one input terminal of an AND gate AN2 via an AND gate AN1 and also fed to the other input terminal of the AND gate AN2 via the AND gate AN1, an OR gate OR1, an AND gate AN3, an AND gate AN4 and an OR gate OR2. As a result, the output signal of the AND gate AN2 is the same as the pattern signal SPPT. The output signal of the AND gate AN2 is applied to tri-state buffers 36 to 39 (FIG. 20) as the enabling signal EN. Therefore, in this case, the buffers 36 to 39 are enabled only when the pattern signal SPPT representative of the row of the animation pattern is "1", and the bits C0 to C3 of the color code are fed from the color code register 35 to the color palette circuit 11 via respective OR gates OR3 to OR6. As a result, the display elements corresponding to the row of the animation pattern in the 1 state are sequentially displayed on the screen in a color designated by the bits C0 to C3 of the color code.

The above operation is also carried out in the other animation pattern processors 21 to 27, and AND gates AN5 to AN11 output the enabling signals EN which are the same as the pattern signals SPPT outputted from the animation pattern processors 21 to 27, respectively.

However, in at least two of the animation pattern processors 20 to 27, when the pattern signals SPPT are "1" at the same time or when the bit data CC is "1", the above operation is not carried out in the manner described. This will now be described. (a) First, there will be described the operation when the bit data CC is "0" and when the pattern signals SPPT are "1" at the same time in at least two of the animation pattern processors 20 to 27. In this case, it is assumed that none of the color codes in the animation pattern processors 20 to 27 are "0000" (not transparent), that is to say, the transparency detection signals SPTP are "0".

For example, when the pattern signal SPPT of the animation pattern processor 20 is rendered "1", the output signal of the AND gate AN3 is rendered "1", so that an output signal of an inverter INV1 is rendered "0". As a result, "0" signal is applied to one input terminal of each of AND gates AN12 to AN18 so that they output "0" signals. And, since the bit data CC of all the animation pattern processors 21 to 27 are "0", "0" signal is applied to one input terminal of each of AND gates AN19 to AN24, so that they output "0" signals. As a result, output signals of OR gates OR7 to OR13 are rendered "0", and therefore the output signals of the AND gates AN5 to AN11 are rendered "0" regardless of the pattern signals SPPT of the animation pattern processors 21 to 27. Thus, when the pattern signal SPPT of the animation pattern processor 20 is "1", the pattern signals SPPT of the animation pattern processors 21 to 27 are ignored even if they are "1". Also, when the pattern signals SPPT of the animation pattern processors 20 and 21 are both "0" and when the pattern signal SPPT of the animation pattern processor 22 is "1", the output signals (enabling signals EN) of the AND gates AN7 to AN11 are rendered "0" regardless of the pattern signals SPPT of the animation pattern processors 23 to 27, as described above.

As will be appreciated from the forgoing, higher priority is established from the animation pattern processor 20 to the animation processor 27. Therefore, when the pattern signal SPPT of the animation pattern processor having higher priority is "1" the pattern signal SPPT of any other animation pattern processor having lower priority is ignored.

Therefore, from a visual point of view, the animation pattern image displayed through the animation pattern processor having higher priority can be seen shallower on the screen while the animation pattern images displayed through the animation pattern processors having lower priority can be seen deeper.

When the pattern signals SPPT of the animation pattern processors 20 to 27 are all "0", "1" signal is applied to each input terminal of an AND gate AN25, so that this AND gate outputs "1" signal. The "1" signal outputted from AND gate AN25 is the above-mentioned still pattern display signal S2 (see FIG. 15), and the image data processing circuit 9 feeds the color code of the still pattern to the color palette 11 only when the still pattern display signal S2 is fed to the image data processing circuit 9.

Therefore, the still pattern image is displayed on the screen deeper than the animation pattern image having the lowest priority.

(b) Next, there will be described the operation when the bit data CC is "1" (i.e., the color mixture processing is to be carried out).

As shown in TABLE 1, it is assumed that the bit data CC stored in the animation pattern processors 20, 23 and 24 are "0", and that the bit data CC stored in the animation pattern processors 21, 22 and 25 to 27 are "1". And, for example, the color codes in the animation pattern processors 20 to 27 are as shown in TABLE 1.

TABLE 1

| No. of animation processor | bit data CC | color code |
|---|---|---|
| 20 | 0 | 1001 |
| 21 | 1 | 1010 |
| 22 | 1 | 1100 |
| 23 | 0 | 1101 |
| 24 | 0 | 1000 |
| 25 | 1 | 0100 |
| 26 | 1 | 0010 |
| 27 | 1 | 0001 |

Reference is first made to the animation pattern processors 20 to 22.

Assuming that only the pattern signal SPPT of the animation pattern processor 21 is rendered "1", this "1" signal is fed to one input terminal of the AND gate AN5 via an AND gate AN30, an OR gate OR20, an AND gate AN31, the OR gate OR1, the AND gate AN19 and the OR gate OR7 and also fed to the other input terminal of the AND gate AN5 via the AND gate 30. As a result, the enabling signal EN outputted from the AND gate AN5 is rendered "1", so that bits C0 to C3 of the color code in the animation pattern processor 21 are fed to the color palette circuit 11 via the respective OR gates OR3 to OR6. Therefore, in this case, the color of the display element to be displayed is determined by the color code "1010" in the animation pattern processor 21 and hence is red.

Also, when only the pattern signal SPPT of the animation pattern processor 22 is rendered "1", this "1" signal is fed to one input terminal of the AND gate AN6 via an AND gate AN32, an OR gate OR21, an AND gate AN33, the OR gate OR20, the AND gate AN31, the OR gate OR1, the AND gate AN3, the AND gate AN4, the OR gate OR2, the AND gate AN19, the OR gate OR7, the AND gate AN20 and the OR gate OR8, and also fed to the other input terminal of the AND gate AN6 via the AND gate AN32. As a result, the enabling signal EN outputted from the AND gate AN6 is rendered "1", so that the color code in the animation pattern processor 22 is outputted, and the color of the display element to be displayed is determined by the color code "1100" and hence is yellow.

When the pattern signals of the animation pattern processors 21 and 22 are rendered "1" at the same time, these "1" signals are fed respectively to input terminals of the AND gates AN5 and AN6 through respective signal paths as described above. As a result, the enabling signals EN outputted respectively from the AND gates AN5 and AN6 are rendered "1", so that the color codes are outputted respectively from the animation pattern processors 21 and 22. Therefore, the output signals of the OR gates OR3, OR4, OR5 and OR6 are rendered "0", "1", "1" and "1", respectively, and the color of the display element to be displayed is determined by the color code "1110" and hence is cyan (FIG. 18). Thus, when the pattern signals SPPT of the animation pattern processors 21 and 22 are rendered "1" at the same time, the color codes are outputted from them, and the logical sum of these color codes is decided to provide a new color code which determines the color of the display element to be displayed.

When either the pattern signals SPPT of the animation pattern processors 20 and 21 or the pattern signals SPPT of the animation pattern processors 20 and 22 are rendered "1" at the same time, either the enabling signals EN outputted from the AND gates AN2 and AN5 or the enabling signals EN outputted from the AND gates AN2 and AN6 are rendered "1" as described above. As a result, either the logical sum of the color codes in the animation pattern processors 20 and 21 or the logical sum of the color codes in the animation pattern processors 20 and 22 is decided to provide a new color code which determines the color of the display element to be displayed. Also, when the pattern signals SPPT of the animation pattern processors 20 to 22 are all rendered "1" at the same time, the logical sum of the color codes in these animation pattern processors 20 to 22 is decided to provide a new color code. The color mixture processing (FIG. 21) is carried out in this manner.

Any one of the pattern signals SPPT outputted from the animation pattern processor 20 to 22 is rendered "1", the output of the AND gate AN3 is rendered "1", so that the output signal of the inverter INV1 is rendered "0". As a result, "0" signal is fed to one input terminals of the AND gates AN12 to AN18, so that the output signals of the AND gates AN12 to AN18 are rendered "0". Since the bit data CC in the animation processor 23 is "0"(see TABLE 1), the output signal of the AND gates AN35 is always "0". And, the output signals of the AND gates AN14 to AN18 are "0", and the output signal of the AND gate AN35 is also "0". Therefore, "0" signal is fed to one input terminals of the AND gates AN7 to AN11, so that the enabling signals outputted from the AND gates AN7 to AN11 are all rendered "0". Therefore, when any one of the pattern signals SPPT of the animation pattern processors 20 to 22 is "1", the pattern signals SPPT outputted from the animation pattern processors 23 to 27 are all ignored. In other words, the group of animation pattern processors 20 to 22 have the highest priority, in this case.

Reference is made to the case where the pattern signals SPPT of the animation pattern processors 20 to 22 are all "0". When the pattern signal SPPT of the animation pattern processor 23 is rendered "1", this "1" signal is fed to one input terminal of the AND gate AN7 via the AND gate AN36, OR gate OR23, AND gate AN37, AND gate AN14 and OR gate OR9 and also fed to the other input terminal of the AND gate AN7 via the AND gate AN36. As a result, the enabling signal EN outputted from the AND gate AN7 is rendered "1", and the color of the display element to be displayed is determined by the color code in the animation pattern processor 23. In this case, the output signal of the inverter INV2 is rendered "0" so that the output signals of the AND gates AN15 to AN18 are rendered "0", and the output signal of the AND gate AN38 is "0" since the bit data CC in the animation pattern processor 24 is "0". Therefore, "0" signals are always fed to one input terminals of the AND gates AN8 to AN11, so that the pattern signals SPPT of the animation pattern processors 24 to 27 are all ignored.

Next, reference is made to the operation of the animation pattern processors 24 to 27 when the pattern signals SPPT of the animation pattern processors 20 to 23 are all "0". As shown in TABLE 1, the bit data CC of the animation pattern processor 24 is "0" while the bit data CC of the animation "1" Therefore, the animation pattern processors 25 to 27 are pattern processors 24 to 27 constitute a group similar to the above-mentioned group of animation pattern processors 20 to 22. Therefore, when at least two of the pattern signals SPPT of the animation pattern processors 24 to 27 are rendered "1" at the same time, the above-mentioned color mixture processing is carried out. Thus, when carrying out the color mixture, some of the animation pattern processors are defined as a group, and the bit data CC of that animation pattern processor which has the highest priority in the group is set to "0", and the bit data CC of the other animation pattern processors in the group are set to "1".

The collision detection will now be described.

It is assumed that the bit data CC and IC of the animation pattern processors 20 to 27 are "0" and that the pattern signals SPPT of the animation pattern processors 20 and 21 are "1". In this case, "0" signal representative of the bit data IC is fed to one input terminal of an AND gate AN40 via an inverter INV3, and "1" signal is fed from the AND gate AN1 to the other input terminal of the AND gate AN40 via the AND gate AN3. As a result, "1" signal is fed from the AND gate AN40 to an input terminal A of the adder 50, so that "1" signal is outputted from the output terminal S of the adder 50. On the other hand, "0" signal representative of the bit data CC of the animation pattern processor 21 is fed to one input terminal of an AND gate AN41 vi an inverter INV4, and "1" signal is fed from the AND gate AN39 to the other input terminal of the AND gate AN41. As a result, input terminals A and B of the adder 51 are supplied with "1" signals, so that "1" signal is outputted from a carry terminal Co of the adder 51. As a result, "1" signal is outputted from an OR gate OR25 via a delay circuit D4. This "1" signal is the above-mentioned collision detection signal S1.

In the manner mentioned above, when at least two of the pattern signals SPPT of the animation pattern processors are rendered "1", "1" signal is outputted from a carry terminal of at least one of the adders 51 to 57, so that the collision detection signal S1 is outputted from the delay circuit D4. When this collision detection signal S1 is outputted, the image data processing circuit 9 (FIG. 15) feeds the outputs of the horizontal and vertical counters 7 and 8 to the CPU 1 via the interface circuit 10. Then, the CPU 1 determines the display position at which a collision between animation patterns has occured. Incidentally, the color of the display element at this collision position is determined by the color code in the animation pattern processor having the highest priority.

Next, it is assumed that the bit data IC of the animation pattern processor 20 is "1" and that the bit data IC of the animation pattern processor 21 is "0". In this case, since "1" signal representative of the bit data IC is fed to the one input terminal of the AND gate AN40 via the inverter INV3, the output signal of the AND gate AN40 is always "0". Therefore, even when the pattern signals SPPT of the animation pattern processors 20 and 21 are rendered "1" at the same time, "1" signal is not outputted from the carry terminal Co of the adder 51, and therefore the collision detection signal S1 is not outputted. Thus, although a collision develops on the screen, the collision signal S1 is not outputted.

As will be appreciated from the foregoing, the collision detection signal S1 is outputted only when the pattern signals SPPT of at least two of the animation pattern processors having the bit data IC of "0" are rendered "1" at the same time.

When the bit data IC of any one of the animation pattern processors 20 to 27 is "1", "0" signal is fed to the other input terminal of one of the AND gates AN40 to AN47, so that none of these AND gates AN40 to AN47 outputs "1" signal. More specifically, the collision will not be detected with respect to the animation pattern stored in any animation pattern processor containing the bit data CC of "1". The reason is that when the bit data CC is "1", the color mixture is effected, and it is not desirable that each time the color mixture is effected, the collision detection signal S1 is outputted.

A signal TP shown in FIG. 19 determines the validity of "1", the signal SPTP is invalid, and when the signal TP is "0", the signal SPTP is valid. When the transparency detection signal SPTP is "1" and valid, the patter signal SPPT is inhibited as can be appreciated from FIG. 19. And, when the transparency signal SPTP is rendered invalid, the color code corresponding to the transparency ("0000") can be set to represent any other color.

A further modified video display controller will now described.

This video display controller is designed so that an increased number of animation patterns can be displayed even when one of the animation patterns is displayed at a display position where the left part of the animation pattern is disposed outside the actual display area of the screen.

The construction of each circuit portion of this video display controller except for an animation pattern processing circuit 13 is identical to that of the aforesaid modified video display controller shown in FIGS. 15 to 20. The animation pattern processing circuit 13 of this video display controller comprises eight animation pattern processors 20 to 27 of an identical construction.

Figure 24:
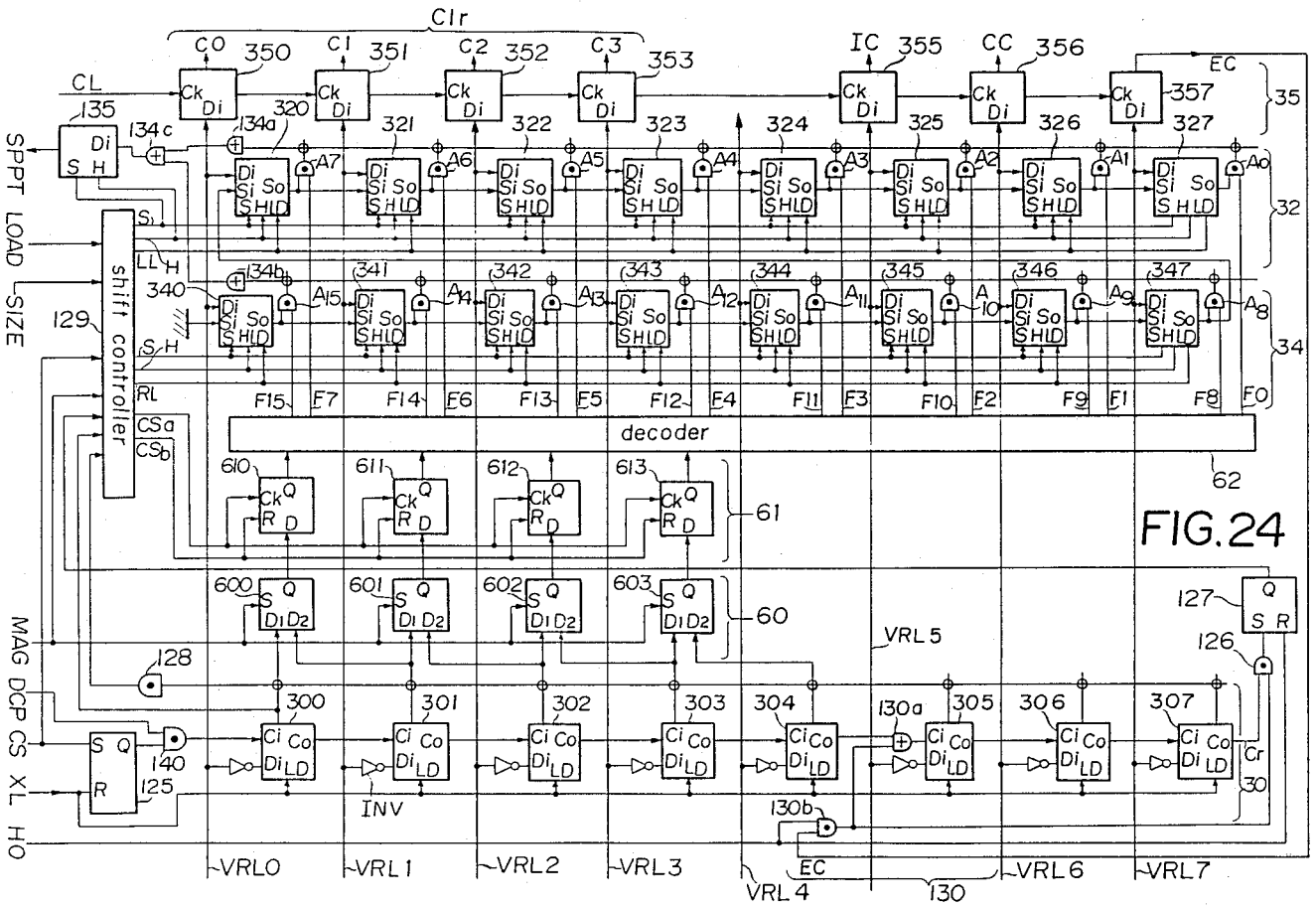
FIG. 24 is one of the animation pattern processors of the further modified video display controller.

FIG. 24 shows a block diagram of the animation pattern processor 20. The animation pattern processor 20 is connected to the image data processing circuit 9 (FIG. 15) via the bus VRL (FIG. 10) and also connected to the color palette circuit 11 via the bus Clr. The bus VRL comprises eight bit lines VRL0 to VRL7, and these bit lines VRLj (j=0, 1 . . . 7) are connected via inverters INV to data input terminals Di of respective bits (stages) 30*j* of an X counter 30 (eight-bit binary counter) and also connected to data input terminals Di of respective latch elements 35*j* of a color code register 35 and data input terminals Di of respective memory elements 32*j* and 34*j* of pattern shift registers 32 and 34, the bit line VRL4 being not connected to the latch.

Before each horizontal scanning is effected, that is to say, during the horizontal non-display period, the application of a load signal XL to a load terminal LD of each bit 30*j* of the X counter 30, the application of a signal CL to a clock terminal CK of each latch element 35*j* of the color code register 35 and the application of signals LL and RL to a load terminals LD of each memory element 32*j*, 34*j* are effected, so that the data are loaded into the X counter 30, each color code register 35 and each pattern shift registers 32 and 34 via the bit lines VRL0 to VRL7.

Data representative of X coordinate of an animation pattern to be displayed which represents the display start position of the animation pattern as mentioned above is fed from the animation pattern control table Ck (the display of the animation pattern is started from the display element designated by the data) and loaded via the inverter INV into the X counter 30 as data representative of initial value NX0. In this case, since the X counter 30 is an eight-bit binary counter, the initial value NX0 is obtained from the following formula:

$$NX0=255-X \quad (2)$$

Next, a color code and bit data IC, CC and EC are fed from the fourth byte of the animation pattern control table Ck, and the color code is loaded into the latch element 350 to 353, and and the bit data IC, CC and EC are loaded into the latch elements 355, 356 and 357, respectively.

Figure 1:
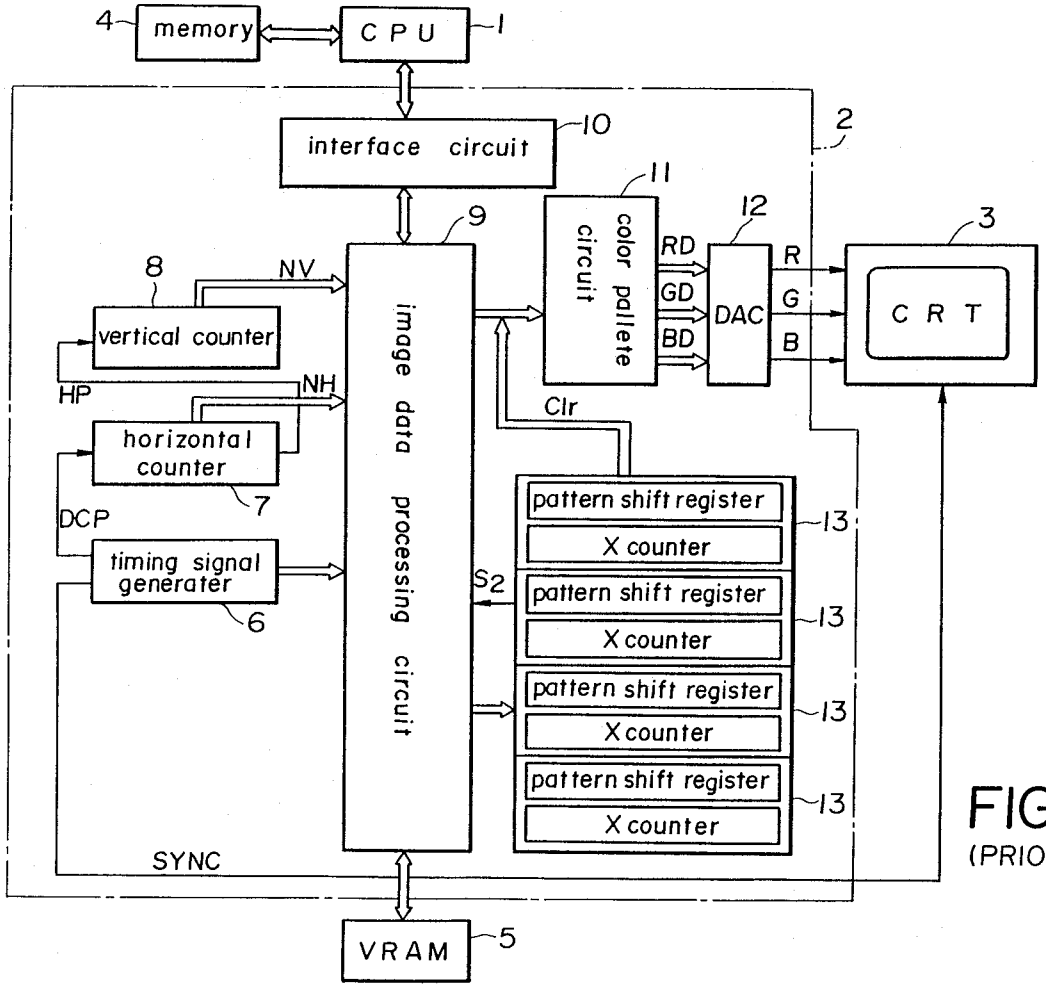
FIG. 1 (PRIOR ART)
FIG. 1 is a block diagram of a conventional video display control system.
Figure 2:
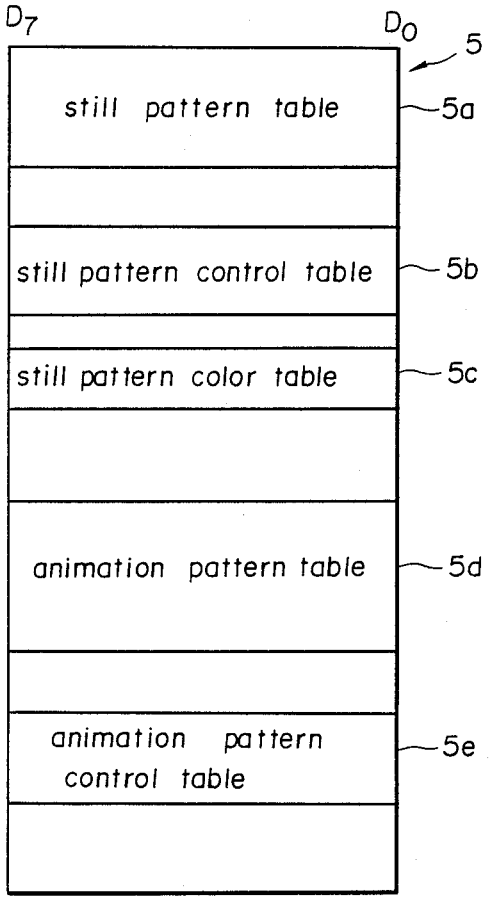
FIG. 2 is a memory map of a VRAM 5 in the video display control system of FIG. 1 which comprises a still pattern table area 5*a*, a still pattern control table area 5*b*, a still pattern color table area 5*c*, an animation pattern table area 5*d*, and an animation control table area 5*e*.
Figure 3:
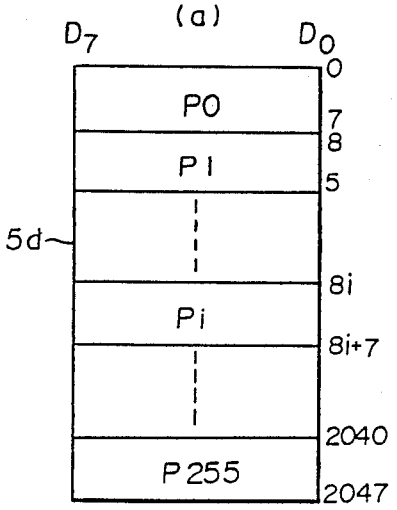
FIG. 3-(*a*) an illustration of the animation pattern table area 5*d* in which animation patterns P0 to P255 are stored.
Figure 3:
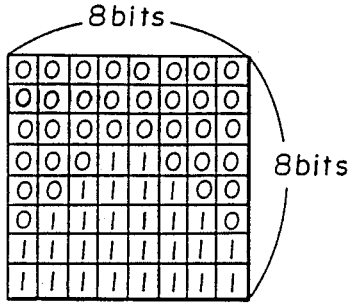

Pattern data representative of a row of display element of the animation pattern to be displayed is transferred from the corresponding byte of the animation pattern table area 5*d* (FIG. 3-(*a*)) to the pattern shift register 32 and the pattern shift register 34. The pattern data is loaded into the pattern shift register 34 only when the animation pattern is displayed by 16 x 16 display elements, i.e., when a signal SIZE is fed from the image data processing circuit 9, and only in such a case, the load signal RL is applied to the pattern shift register 34.

Thus, before the horizontal display is effected, the data representative of the initial value NX0 is loaded into the X counter 30, and the color code and bit data IC, CC and EC are loaded into the latch 35, and the pattern data representative of the dot pattern of the animation pattern to be displayed is loaded into the pattern shift registers 32 and 34.

Then, when the horizontal display is started, the eight animation pattern processors 20 to 27 process the data in a parallel fashion to display the animation patterns on the display screen.

At this time, first, in those of the animation pattern processors 20 to 27 which contain the bit data EC in the "0" state, all of the X counters 30 simultaneously start their count-up operations which are effected in synchronization with the counting operation of the horizontal counter 7, and when the display position of the first display element reaches the position (X, Y) shown in FIG. 14, the pattern shift registers 35 and 34 shift out the pattern data to display the animation pattern represented by them.

More specifically, a carry input terminal Ci of each bit 30*j* of the X counter 30 of the animation pattern processor 20 is connected to a carry output terminal Co of the preceding bit thereof. Each one of the bits 30*j* of this X counter 30 adds a pulse signal of "1" applied to its carry input terminal Ci to the contents thereof, and outputs a pulse signal of "1" from its carry output terminal Co when both of the input pulse signal and the contents are "1". The carry input terminal Ci of the first bit 300 of the X counter 30 is connected to an output terminal of an AND gate 140. One input terminal of this AND gate is connected to an output terminal Q of an SR flip-flop 125 (hereinafter referred to as "SRFF") which is set by a count-start signal CS, the other input terminal of the AND gate 140 being supplied with the output signal DCP of the horizontal counter 7. A carry output terminal Co of the last bit 307 of the X counter 30 is connected to a set terminal S of an SRFF 127 via an AND gate 126. When the count-start signal CS sets the SRFF 125 at the start of the display of a horizontal scanning line, the X counter 30 sequentially counts up its contents from its initial value NX0 (=255−X) which is represented by the above-mentioned formula (2). As described above, this count-up is effected in synchronization with the count-up of the horizontal counter 7, and when the display position on the horizontal scanning line becomes X, the count value NX of the X counter 30 reaches 255. At this time, the outputs of the bits 300 to 307 of the X counter 30 are all rendered "1", and the output of an AND gate 128 is rendered "1" and is fed to a shift controller 129 so that the pattern shift registers 32 and 34 begin their shifting operation.

On the other hand, in each of those animation pattern processors 20 which contain the data representative of the bit data EC in the "1" state, a value of 32 is first added to the initial value NX0 of the X counter 30 to change it, and the X counter 30 begins to count up its contents from the the changed initial value NX0. As a result, the row of display elements of the animation pattern is shifted left by 32 display elements from the position (X, Y) to the position (X 32, Y). Thus, when the bit data EC is set to "1", the X coordinate contained in the second byte of the corresponding animation pattern control table Ck represents X coordinate of the animation pattern on an imaginary screen which is shifted left by 32 display elements with respect to the actual display screen. For example, if the bit data EC is "1" and when the X coordinate of the animation pattern is "35", the leftend display elements of the animation pattern are displayed at the column "3" of the actual screen.

More specifically, an OR gate 130*a* is coupled between the carry output terminal Co of the bit 304 of the X counter 30 and the clock input terminal Ci of the next bit 305, and the output terminal of an AND gate 130*b* is connected to the other input terminal of the OR gate 30*a*. The AND gate 30*b* produces the logical product of the bit data EC and a start signal Ho fed thereto at the start of the horizontal display, and when the start signal Ho is fed to the AND gate 30*b* while the bit data EC is "1", "1" signal is fed to the clock input terminal Ci of the bit 305 of the X counter 30 so that a value of 32 is added to the contents of the X counter 30. In this case, since the initial value NX0 of the X counter 30 has been "255 −X", the new value NX0′ obtained as the results of the addition is represented by the following formula:

$$NX0' = 255 - X + 32 \quad (3)$$

Therefore, when X≧32 is provided, the new value NX0′ is less than 255, and then the same processing as described above for the case where the bit data EC is "0" is carried out.

Also, when X≦31 is provided, the value NX0′ is not less than 256. In the X counter 30, "256" is equal to "0" (256=0), and therefore the count NX0′ in this case is expressed by the following formula:

$$NX0' = 256 - X + 31 = 31 - X \quad (4)$$

Therefore, if the value of X is not more than 31, then NX0′≧0 is provided. In this case, part of the animation pattern is hidden on the left side of the screen, and at the time of this addition, "1" signal is fed from the carry output terminal Co of the bit 307 to one input terminal of the AND gate 126, the other input terminal of this AND gate 126 being supplied with "1" signal from the AND gate 130*b*. As a result, the SRFF 127 is set by "1" signal from the AND gate 126, so that "1" signal is fed from a terminal Q of the SRFF 127 to the shift controller 129. As a result, the pattern data are serially outputted from the intermediate bits of the pattern shift registers 32 and 34 in a manner described later, The above-mentioned circuit elements 130*a*, 130*b* and 305 constitute adder means 130.

Next, the outputs of the lower four bits 300 to 303 of the X counter 30 are supplied respectively to first input terminals D1 of selector elements 600 to 603 of a four-bit selector 60, and also the outputs of the four bits 301 to 304 of the X counter 30 are supplied to second input terminals D2 of the selector elements 600 to 603 of the selector 60. The selector 60 is responsive to a signal MAG supplied to selection terminals S of the selector elements 600 to 603 thereof to switch the input data. The signal MAG is "1" when the magnification of the animation pattern (twice magnification) is effected, and this signal is "0" when there is no magnification of the animation pattern (i.e., normal display). When the signal MAG is "0", the outputs of the lower four bits 300 to 303 of the X counter 30 are fed to input terminals D of latch elements 610 to 613 of a four-bit latch 61 through the selector elements 600 to 603, respectively. And, when the signal MAG is "1", the outputs of the bits 301 to 304 are fed to the input terminals D of the latch elements 320 to 323 through the selector elements 600 to 603, respectively.

The latch 61 is responsive to a signal CSa fed from the shift controller 129 to clock input terminals CK of its latch elements to latch the data fed from the selector 60. When the signal at the output terminal Q of the SRFF 127 is "1" (i.e., the bit data EC is "1" and X≦31 is provided) the shift controller 129 outputs the signal CSa in response to a count start signal CS. Then, the count NX of the X counter 30 is incremented by one from the initial value NX0 (=31−X) represented by the formula (4), which is expressed by the following formula (5), the output data of the selector 60 is latched by the latch 61.

$$NX=32-X \quad (5)$$

In the case where the signal MAG is "0", the lower four bits of the above count NX (=32−X) are outputted from the output terminals Q of the selector 60, and when the signal MAG is "1", the lower five bits of the above count NX except for the MSB are outputted from the output terminals Q of the selector 31. Therefore, value "n" loaded into the latch 61 is determined in accordance with the value X as shown in TABLE 2. The value "n" once loaded into the latch 61 is maintained until reset terminals R of the latch elements 610 to 613 are supplied with a reset signal CSb which is outputted from the shift controller 129 in accordance with the next count start signal CS.

TABLE 2

| X | 32 − X | "n": (MAG = "0") | "n": (MAG = "1") |
|---|---|---|---|
| 0 | 32 | : | : |
| 1 | 31 | : | 15 |
| 2 | 30 | : | 15 |
| 3 | 29 | : | 14 |
| 4 | 28 | : | 14 |
| 5 | 27 | : | 13 |
| : | : | : | : |
| 13 | 19 | : | 9 |
| 14 | 18 | : | 9 |
| 15 | 17 | : | 8 |
| 16 | 16 | : | 8 |
| 17 | 15 | 15 | 7 |
| 18 | 14 | 14 | 7 |
| 19 | 13 | 13 | 6 |
| 20 | 12 | 12 | 6 |
| 21 | 11 | 11 | 5 |
| 22 | 10 | 10 | 5 |
| 23 | 9 | 9 | 4 |
| 24 | 8 | 8 | 4 |
| 25 | 7 | 7 | 3 |
| 26 | 6 | 6 | 3 |
| 27 | 5 | 5 | 2 |
| 28 | 4 | 4 | 2 |
| 29 | 3 | 3 | 1 |
| 30 | 2 | 2 | 1 |
| 31 | 1 | 1 | 0 |

Thus, the value "n" latched in the latch 61 in the form of a binary code is converted by a decoder 62 into a hexadecimal code, and signals F0, F1, F2 . . . F15 corresponding respectively to the value N of 0, 1, 2 . . . 15 are fed from the decoder 62 to first input terminals of AND gates A0, A1, A2 . . . A15, respectively. On the other hand, outputs of the memory elements 327, 326, . . . 320 and 347, 346 . . . 340 of the pattern shift registers 32 and 34 are supplied to the second input terminals of the AND gates A0, A1 . . . A7 and A8, A9 . . . A15, respectively. The outputs of the AND gates A0 to A7 are supplied to the respective input terminals of an OR gate 134*a*, and the outputs of the AND gates A8 to A15 are supplied to respective input terminals of an OR gate 134*b*. The outputs of the OR gates 134*a* and 134*b* are supplied to an input terminal Di of a memory element 135 via an OR gate 134*c*. As a result, one of the AND gates An (n=0, 1, 2, . . . 15) opened in accordance with the value "n" serves as a gate for outputting the pattern data, and the pattern data stored in the pattern shift register 32 and the pattern shift register 34 are fed via the AND gate An, OR gate 134*a* (134*b*) and OR gate 134*c* to the memory element 135 and is outputted therefrom as a serial pattern signal SPPT. The color code stored in the bits 350 to 353 is outputted therefrom in accordance with the pattern signal SPPT of "1" and is supplied via the color bus Clr to the color palette circuit 11, so that the row of the animation pattern is displayed on the CRT screen.

Each of the pattern shift registers 32 and 34 are designed to store dot pattern data of 8 bits. In the case where the dot pattern data is composed of 8 bits, that is to say, the animation pattern is formed by 8×8 display elements, the pattern shift register 32 is used alone. And, in the case where the dot pattern data is composed of 16 bits, that is to say, the animation pattern is formed by 16×16 display elements, the pattern shift register 32 and the pattern shift register 34 connected thereto are used in combination. As described above, the dot pattern data to be displayed during the next horizontal display period are loaded into the memory elements 320 to 327 of the pattern shift register 32 by a load signal LL supplied from the shift controller 129 to load terminals LD of the memory elements 320 to 327 during the horizontal non-display period. The dot pattern data thus loaded into the memory elements 320 to 327 are hereinafter referred to as "dot data D0 to D7" Similarly, 8-bit dot pattern data to be displayed next to the above-mentioned dot data are loaded into the memory elements 340 to 347 of the shift register 34 by a load signal RL supplied to load terminals LD of the memory elements 340 to 347. The dot pattern data thus loaded into the memory elements 340 to 347 are hereinafter referred to as "dot data E0 to E7". Then, during the horizontal display period, the dot data D0 to D7 and E0 to E7 are sequentially outputted from the AND gate An in accordance with the shift signal S and hold signal H supplied from the shift controller 129.

First, when the signal at the output terminal Q of the SRFF 127 is "0", that is to say, the whole of the animation pattern is to be displayed on the screen, the value "n" latched in the latch 61 is rendered "0", and the signal F0 is outputted from the decoder 62. Therefore, the AND gate A0 is opened for outputting the dot pattern data. Then, the X counter 30 counts X, and when its count NX reaches 255, AND gate 28 feeds "-1" signal to the shift controller 129. Therefore, when a signal MAG is "0", the shift controller 129 outputs the shift signal S in synchronization with the counting of the horizontal counter 7. And, when the signal MAG is "1", the shift controller 129 alternately outputs the shift signal S and the hold signal H in accordance with the even and odd values of the count NX of the X counter 30. As a result, when the signal MAG is "0", the dot data D7, D6 . . . D0 (E7, E6 . . . E0) are sequentially outputted from the AND gate A0, and the display elements corresponding to these dot data are sequentially displayed on the horizontal scanning line from the position X. When the signal MAG is "1", the dot data D7, D7, D6, D6 . . . D0, D0 (E7, E7, E6, E6 . . . E0, E0) are sequentially outputted from the AND gate A0, and the display elements corresponding to these dot data are sequentially displayed on the screen.

Next, when the signal at the output terminal Q of the SRFF 127 is "1", that is to say, part of the animation pattern is hidden on the left side of the screen, the value "n" (n≠0) is latched in the latch 61, and a signal Fn is outputted from the decoder 62. Therefore, the AND gate An is opened for outputting the dot pattern data. Then, each time the count NX of the X counter 30 is incremented by one, the shift controller 129 outputs the shift signal S when the signal MAG is "0", and also outputs alternately the shift signal S and the hold signal H in accordance with the even and odd values of the count NX when the signal MAG is "0". As a result, when the signal MAG is "0", the dot data shown in TABLE 3 are sequentially outputted from the AND gate An, and the display elements corresponding to these dot data are sequentially displayed on the screen from a left end thereof. For example, when (n=5) is provided, the AND gate A5 is opened to sequentially output the dot data D2, D1, D0 (E7 . . . E0), so that the display elements represented by these dot data are displayed from the left end of the screen. And, when the signal MAG is "1", each of these display elements is displayed twice to magnify the animation pattern image twice.

TABLE 3

| AND gate | Display screen | | | | | | | | | | | | | | |
|---|---|---|---|---|---|---|---|---|---|---|---|---|---|---|---|
| A1 | D6 | D5 | D4 | D3 | D2 | D1 | D0 | E7 | E6 | E5 | E4 | E3 | E2 | E1 | E0 |
| A2 | D5 | D4 | D3 | D2 | D1 | D0 | E7 | E6 | E5 | E4 | E3 | E2 | E1 | E0 | |
| A3 | D4 | D3 | D2 | D1 | D0 | E7 | E6 | E5 | E4 | E3 | E2 | E1 | E0 | | |
| A4 | D3 | D2 | D1 | D0 | E7 | E6 | E5 | E4 | E3 | E2 | E1 | E0 | | | |
| A5 | D2 | D1 | D0 | E7 | E6 | E5 | E4 | E3 | E2 | E1 | E0 | | | | |
| A6 | D1 | D0 | E7 | E6 | E5 | E4 | E3 | E2 | E1 | E0 | | | | | |
| A7 | D0 | E7 | E6 | E5 | E4 | E3 | E2 | E1 | E0 | | | | | | |
| A8 | E7 | E6 | E5 | E4 | E3 | E2 | E1 | E0 | | | | | | | |
| A9 | E6 | E5 | E4 | E3 | E2 | E1 | E0 | | | | | | | | |
| A10 | E5 | E4 | E3 | E2 | E1 | E0 | | | | | | | | | |
| A11 | E4 | E3 | E2 | E1 | E0 | | | | | | | | | | |
| A12 | E3 | E2 | E1 | E0 | | | | | | | | | | | |
| A13 | E2 | E1 | E0 | | | | | | | | | | | | |
| A14 | E1 | E0 | | | | | | | | | | | | | |
| A15 | E0 | | | | | | | | | | | | | | |

The operation of the above-mentioned embodiment will now be described.

(A) NORMAL DISPLAY OF ANIMATION PATTERN (bit data EC is "0")

The display of an animation pattern image is effected by assigning a selected display position to the animation pattern Pi (8×8 display elements or 16×16 display elements) of which data is stored in the animation pattern table area 5*d*. The assignment of the display position is effected by the animation control table Ck, and the display position is shifted suitably to produce a required animation pattern image. The dot pattern data representative of each animation pattern to be displayed and the data representative of the display position thereof are determined by the following procedure and are loaded into the corresponding one of the animation pattern processors 20 to 27.

(1) First, it is detected whether there is any animation pattern to be displayed on the next horizontal scanning line during the horizontal display period. More specifically, ALU B7 (FIG. 10) sequentially checks the animation pattern control tables Ck in accordance with the address data produced by the animation pattern number counter B4 and compares the Y coordinate with the vertical count NV to determine whether there is any animation pattern to be displayed. In the case where there is the animation pattern to be displayed, the contents of the counter B4 are loaded into the animation pattern number-FIFO B5. In this manner, the data designating those addresses of the animation pattern control tables Ck which store the data representative of the animation patterns to be displayed on the next horizontal scanning line are sequentially loaded into the animation pattern number-FIFO B5. And, either when eight data are stored in the FIFO B5 or when the check through the animation pattern control tables Ck is completed, this processing is finished.

(2) During the next horizontal non-display period, the data in the addresses of the animation pattern control tables Ck of which address data have been loaded into the FIFO B5 are sequentially read from VRAM 5, and these data as well as the respective dot pattern data representative of the animation patterns Pi are sequentially loaded into eight animation pattern processors 20 to 27, respectively. More specifically, the complementary data of the data stored in the second byte of each animation pattern control table Ck and representing the X coordinate (hereinafter referred to as "value X") is loaded into the X counter 30 of the corresponding one of the animation pattern processors 20 to 27 as its initial value NX0 (=255−X), and the color code and the bit data IC, CC and EC are loaded into the color code register 35. Also, the address data for addressing the animation pattern table area 5*a* is determined through the ALU B7 in accordance with the data stored in the animation pattern control table Ck and representing the name of the animation pattern Pi and the vertical count NV. The dot data D0 to D7 and E0 to E7 are read from the addresses designated by these address data and loaded into the shift registers 32 and 34, respectively. However, the dot data E0 to E7 are loaded into the pattern shift register 34 only when the animation pattern is formed by 16×16 display elements, that is to say, a signal SIZE (FIG. 24) is "1". In this manner, the data processing during the horizontal non-display period of this horizontal scanning line is completed.

(3) At the time when the display of the horizontal scanning line is initiated, the start signal H0 and the count start signal CS are supplied, so that the SRFF 125 is set while the SRFF 127 is reset. As a result, the signal at the output terminal Q of the SRFF 127 is rendered "0", and the shift controller 129 outputs the reset signal CSb, so that the latch elements 610 to 613 of the latch 61 are reset to render their outputs "0" (i.e., n ="0"). Therefore, the output F0 of the decoder 62 is rendered "1", and the AND gate A0 is opened for outputting the dot data. As a result, the output of the eighth bit 327 of the pattern shift register 32 is fed to the memory element 135 via the AND gate A0, OR gate 134*a* and OR gate 134*c*.

On the other hand, when the SRFF 125 is set by the count start signal CS, the X counter 30 starts the count-up operation. In this case, since the initial value NX0 of the X counter 30 is (255 - X), the count NX of this counter 30 reaches "255" when its contents are incremented X times, so that the output of the AND gate 128 is rendered "1". Therefore, the shift controller 129 outputs the shift signal S, and the bit data in each of the pattern shift registers 32 and 34 and the memory element 135 are shifted one by one, so that the dot data D7, D6 . . . D0 (E7, E6 . . . E0) are sequentially outputted as a serial pattern signal SPPT from the memory element 135. The pattern signal SPPT is fed via a priority circuit 40 (FIG. 11), which deletes the animation pattern data having a low priority, to the color code register 35 for outputting the color code therefrom. This color code is fed to the color palette circuit 11 via the color bus Clr so that the display element is displayed in a selected color. In this manner, the animation pattern image Pi is displayed at the selected display position (X, Y). The same data processing is effected in the other animation pattern processors 21 to 27, so that the selected animation pattern images are successively displayed on the screen.

(B) DISPLAY OF ANIMATION PATTERN (bit data EC is "1"; Value X is not less than 32)

In this case, the data are loaded into the animation pattern processor 20 to 27 as described above for Item (A).

At the start of the display of the horizontal scanning line, the start signal H0 is supplied whereupon the output of the AND gate **130*b* is rendered "1" since the bit data EC is "1" As a result, a value of 32 is added to the initial value NX0 (=255−X) of the X counter 30 via the OR gate 130*a*. In this case, since X≧32 is provided, this addition result will not exceed "256". Then, the processing proceeds as described above for Item (A). The animation pattern image Pi is displayed at a position shifted left from the position (X, Y) by 32 display elements, that is to say, the position (X−32, Y). In this case, the counting of the X counter 30** is started at the start of the display of the horizontal scanning line, and therefore with this method, there is overcome the disadvantage that the counting of the X counter must be started a predetermined number of display elements (for example, 32 display elements) before the display of the horizontal scanning line is started as is the case with the conventional method. (C) DISPLAY OF ANIMATION PATTERN (bit data EC is "1"; Value X is not more than 31)

In this case, the data are also loaded into the animation pattern processors 20 to 27 as described above for Items (A) and (B).

When the start signal H0 is supplied at the start of the horizontal display, a value of 32 is added to the initial value NX0 (=255−X) as described above for Item (B). Therefore, in this case, since X≦31 is provided, this addition result exceeds "256" so that a carry signal Cr is outputted from the highest bit 217 of the X counter 30, and the initial value NX0 is changed to a value of (31−X) as obtained from the above-mentioned formula (4). Also, the SRFF 127 is set by the carry signal Cr, and therefore the signal at the output terminal Q thereof is rendered "1", so that the shift controller 129 outputs the signal CSa. As a result, the value "n" determined in accordance with the value X as shown in TABLE 2 is set in the latch 61. As a result, the signal Fn of "1" is outputted from the decoder 62, so that the AND gate An is opened for outputting the dot data, and this condition is maintained during one horizontal display period.

Then, the shift controller 129 outputs the shift signal S to the pattern shift registers 32 and 34 and the memory element 135, and the dot data as shown in TABLE 3 are sequentially outputted from the AND gate An to the memory element 135 via the OR gate **134*a* (or the OR gate 134*b* when the opened AND gate An is A8 to A15) and OR gate 134*c*. The memory element 135** outputs these dot data as the serial pattern signal SPPT. The dot data E0 to E7 are used only when the animation pattern to be displayed is formed by 16×16 display elements. TABLE 3 shows the display condition when the signal MAG is "0", and when the signal MAG is "1", the animation pattern represented by each of the dot data D0 to D7, E0 to E7 is displayed twice successively. As described above, this control is effected by outputting alternately the shift signal S and the hold signal H.

As described above, with the construction of this embodiment, when the bit data EC is "1", the initial value NXO of the X counter 30 is incremented at the start of the horizontal display period. Therefore, there is no need to start the counting of the X counter before the start of the display period as is the case with the conventional system. Therefore, the time required for the loading of the necessary data during the horizontal non-display period is extended, and the number of animation patterns to be displayed on one horizontal scanning line can be increased about 1.5 times larger as compared with that achieved with the conventional system.

What is claimed is:

1. A video display control system for displaying a video image on a screen of a video display unit comprising:

(a) memory means for storing (i) first to Nth (N≧2) animation pattern data, each representing an animation pattern composed of a predetermined number of pattern elements, each of said pattern elements corresponding to at least one of display elements on said screen, (ii) first to Nth display position data representing first to Nth display positions each of which is a position on said screen; and (b) display control means which comprises:

(I) reading means for reading said first to Nth animation pattern data and said first to Nth display position data from said memory means;

(II) processing means for receiving said first to Nth animation pattern data and said first to Nth display position data and for serially outputting each of first to Nth pattern element data, respectively, each of said Kth (1≦K≦N) pattern element data corresponding to one of said predetermined number of pattern elements composing the animation pattern corresponding to the Kth animation pattern data;

(III) detection means, receiving said first to Nth pattern element data serially outputted from said processing means, for detecting an occurrence of at least two pattern element data outputted from the same display element on said screen from said processing means to output a detection signal that has coordinate information for a display position where said at least two pattern elements are to be displayed;

(IV) current position data generating means for generating current position data representative of a position of a display element subject to display at present on said screen; and (V) start signal generating means for generating first to Nth start signals by comparing each of said first to Nth display position data with said current position data, said processing means outputting said first to Nth pattern element data in response to said first to Nth start signals, respectively.

2. A video display control system according to claim 1, wherein said memory means further stores:

first to Nth pattern name data each specifying one among the animation pattern corresponding to said first to Nth animation patterns data, said first to Nth animation pattern data read from said memory means being animation patterns specified by said first to Nth pattern name data.

3. A video display control system according to claim 1, wherein said processing means comprises first to Nth processing circuits for outputting said first to Nth animation pattern data, respectively, said first to Nth processing circuits respectively having first to Nth flag register each of which can set a flag indicating that said first to Nth pattern data serially outputted therefrom are subject to the detection of said detection means, said at least two pattern element data being outputted from ones in which the flags are set among said first to Nth processing circuits.

4. A video display control system according to claim 1 further comprising a central processing unit for holding said current position data in response to said detection signal.

5. A video display control system for use with a video display unit having a screen which provides, in accordance with a clock signal synchronized with vertical and horizontal synchronization signals, a plurality of columns and a plurality of rows of display elements on said screen, each for displaying in a designated color, the video display control system comprising:

(b) display control means which comprises:

(I) horizontal counter means responsive to said clock signal for generating a horizontal count representative of a current horizontal display position of a display element on the screen;

(II) reading means for reading said animation pattern data and said position data from said memory means;

(III) shift register means including a predetermined number of stages for storing pattern element data representative of pattern elements which correspond to a row of said animation pattern, each stage of said shift register means having an output terminal;

(IV) start signal generating means for generating a start signal by comparing said horizontal count with said display position data;

(V) clock signal feeding means responsive to said start signal for feeding said clock signal to said shift register means said clock signal feeding means comprising:

(i) counter means for being preset with a value corresponding to said read position data and said predetermined number, for counting said clock signal in response to said start signal and outputting a control signal in accordance with count value thereof; and (ii) control circuit means responsive to said control signal for feeding said clock signal to said shift register means; and (VI) selecting means responsive to said start signal for selecting one of the output terminals of said shift register means in accordance wit said position data and a predetermined number of display elements by which said animation pattern on the screen is to be shifted;

wherein said selecting means includes means for selecting the output terminal of the last stage of said shift register means if said control signal is not fed from said counter means when said start signal is applied thereto, said selecting means selecting said one of said output terminals of said shift register means in accordance with tee contents of said counter means if said control signal is fed from said counter means when said start signal is applied thereto;

(VII) said shift register means feeding pattern element data derived from said selected output terminal to the video display unit;

(c) whereby said animation pattern is displayed at a new display position shifted in the horizontal direction by said predetermined number of display elements with respect to the display position designated by said display position data.

* * * * *